US009540140B2

(12) United States Patent
Hassell et al.

(10) Patent No.: US 9,540,140 B2
(45) Date of Patent: Jan. 10, 2017

(54) BAKERY TRAY

(71) Applicant: Rehrig Pacific Company, Los Angeles, CA (US)

(72) Inventors: Jon P. Hassell, Atlanta, GA (US); Jonathan Javier Muñoz Hernandez, Cumbres del Lago (MX)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 14/510,702

(22) Filed: Oct. 9, 2014

(65) Prior Publication Data

US 2015/0151875 A1 Jun. 4, 2015

Related U.S. Application Data

(60) Provisional application No. 61/889,015, filed on Oct. 9, 2013.

(51) Int. Cl.

| | |
|---|---|
| ***B65D 25/30*** | (2006.01) |
| ***B65D 21/02*** | (2006.01) |
| ***B65D 1/34*** | (2006.01) |
| *B65D 21/06* | (2006.01) |
| *B65D 1/42* | (2006.01) |
| *B65D 21/04* | (2006.01) |

(52) U.S. Cl.

CPC ..... *B65D 21/0215* (2013.01); *B65D 1/34* (2013.01); *B65D 21/046* (2013.01); *B65D 1/42* (2013.01); *B65D 21/041* (2013.01); *B65D 21/06* (2013.01); *B65D 25/30* (2013.01)

(58) Field of Classification Search

CPC ... B65D 21/0215; B65D 21/06; B65D 21/046; B65D 21/041; B65D 1/34; B65D 1/42; B65D 25/30

USPC ..... 206/386, 503, 504, 506, 507, 509, 511,206/512, 557; 220/607

See application file for complete search history.

(56) References Cited

U.S. PATENT DOCUMENTS

| | | | |
|---|---|---|---|
| 1,336,292 | A | 4/1920 | Goodfriend |
| 1,542,115 | A | 6/1925 | Weis |
| 1,568,742 | A | 1/1926 | Jung |
| 1,623,692 | A | 4/1927 | Lockwood |

(Continued)

FOREIGN PATENT DOCUMENTS

| | | | |
|---|---|---|---|
| AU | 2009222632 | A1 | 4/2010 |
| CA | 2276863 | A1 | 2/2000 |

(Continued)

*Primary Examiner* — J. Gregory Pickett
*Assistant Examiner* — Elizabeth Volz
(74) *Attorney, Agent, or Firm* — Carlson, Gaskey & Olds, P.C.

(57) ABSTRACT

A bakery tray according to one embodiment includes a base a front wall and a rear wall. A pair of opposed side walls extend upward from side edges of the base. Each side wall including a pair of stacking feet and a center projection. Each side wall includes an upper support surface between an inner rail and an outer wall. The inner rail is interrupted by a plurality of pockets arranged to receive the stacking feet and the center projection of an identical tray stacked thereon in a high stack position and in a low stack position. The outer wall includes a plurality of recesses aligned with the plurality of pockets. The tray may provide a substantially constant height support surface between the pockets. Further, stops may be provided at front and rear ends of the upper support surface.

23 Claims, 25 Drawing Sheets

(56) References Cited

U.S. PATENT DOCUMENTS 1,671,450 A 5/1928 Ross
1,720,947 A 7/1929 Duggan
1,730,919 A 10/1929 Debs
1,840,310 A 1/1932 Debs
1,953,935 A 4/1934 Jackson
2,123,837 A 7/1938 Thomas et al.
2,150,623 A 3/1939 Jackson
2,232,632 A 2/1941 Reynolds
2,896,835 A 7/1959 Burkhardt et al.
3,155,268 A 11/1964 Fogerty et al.
3,164,478 A 1/1965 Bostrom
3,182,856 A 5/1965 Goltz
3,270,913 A 9/1966 Bridenstine
RE26,350 E 2/1968 Wilson
3,392,875 A 7/1968 Bockenstette
3,401,828 A 9/1968 Bockenstette
3,420,402 A 1/1969 Frater et al.
3,438,544 A 4/1969 Cloyd
3,478,998 A 11/1969 Burford
3,613,943 A 10/1971 Bridenstine
D224,366 S 7/1972 Rehrig
3,675,815 A 7/1972 Rehrig
3,780,905 A 12/1973 Herolzer
3,825,114 A 7/1974 Johnson et al.
3,828,705 A 8/1974 Morrison
3,865,239 A 2/1975 Herolzer et al.
3,937,327 A 2/1976 Carroll
3,951,265 A 4/1976 Carroll
4,000,817 A 1/1977 Sanders et al.
4,023,680 A 5/1977 Thurman
D245,648 S 9/1977 Taylor
D247,648 S 3/1978 Carroll et al.
4,093,070 A 6/1978 Stahl
4,093,071 A 6/1978 Stahl et al.
4,102,453 A 7/1978 Carroll et al.
D249,185 S 8/1978 Carroll et al.
4,106,624 A * 8/1978 Thurman ..... B65D 21/046 206/507
4,106,625 A 8/1978 Carroll et al.
4,109,791 A 8/1978 Clipson et al.
D252,961 S 9/1979 Carroll et al.
4,189,052 A 2/1980 Carroll et al.
4,238,032 A 12/1980 Thurman
4,320,837 A 3/1982 Carroll et al.
4,364,477 A 12/1982 Stromberg
4,379,508 A 4/1983 Miller et al.
4,423,813 A 1/1984 Kreeger et al.
4,519,503 A 5/1985 Wilson
4,522,301 A 6/1985 Ajmera
4,523,681 A 6/1985 Kreeger
4,759,451 A 7/1988 Apps
4,807,756 A 2/1989 Young et al.
4,885,989 A 12/1989 Korpan
4,936,458 A 6/1990 Tabler
4,960,207 A 10/1990 Tabler et al.
4,960,211 A 10/1990 Bailey
4,982,844 A 1/1991 Madan et al.
5,035,326 A 7/1991 Stahl
D319,908 S 9/1991 Stahl
5,080,314 A 1/1992 Moyer et al.
5,232,609 A 8/1993 Badinier et al.
5,249,699 A 10/1993 Williams
5,287,966 A 2/1994 Stahl et al.
5,292,001 A 3/1994 Langenbeck et al.
D348,138 S 6/1994 Lang-Ree et al.
D348,344 S 6/1994 Apps
D350,028 S 8/1994 Apps
5,344,022 A 9/1994 Stahl
5,372,257 A 12/1994 Beauchamp et al.
5,581,902 A 12/1996 Didion et al.
5,582,296 A 12/1996 Beauchamp et al.
5,588,549 A 12/1996 Furtner et al.
5,615,921 A 4/1997 Marley et al.
D382,404 S 8/1997 Cope
5,671,857 A 9/1997 Stromberg
5,881,902 A 3/1999 Ackermann et al.
5,896,992 A 4/1999 McGrath
5,921,566 A 7/1999 Kern et al.
5,979,654 A 11/1999 Apps et al.
D439,049 S 3/2001 Koefelda
6,260,706 B1 7/2001 Koefelda
D446,939 S 8/2001 Koefelda
6,273,006 B1 8/2001 Reutter et al.
6,273,259 B1 8/2001 Stahl
6,394,274 B1 5/2002 Cheeseman
D458,684 S 6/2002 Bryant et al.
6,607,199 B2 8/2003 Gruber
6,837,377 B2 1/2005 Shuert
6,857,642 B2 2/2005 Gruber
6,886,710 B2 5/2005 Verna et al.
6,953,116 B2 10/2005 Verna et al.
7,152,752 B2 12/2006 Kurtenbach
7,195,127 B2 3/2007 Hsu et al.
7,258,246 B2 8/2007 Tingley
7,320,405 B2 1/2008 Stahl
7,350,789 B2 4/2008 Uffner et al.
7,484,621 B2 2/2009 Apps et al.
D598,684 S 8/2009 Stahl
7,637,373 B2 12/2009 Stahl
7,686,167 B1 3/2010 Stahl
7,699,172 B2 4/2010 McTavish et al.
7,784,615 B2 8/2010 Stahl
7,823,728 B2 11/2010 Baltz
7,861,864 B2 1/2011 Hassell et al.
8,191,910 B2 6/2012 Landau et al.
8,561,832 B2 10/2013 Hassell
8,695,795 B1 4/2014 Huber
8,720,687 B2 5/2014 Hassell
8,763,809 B2 7/2014 Baltz et al.
9,156,588 B2 10/2015 Hassell
9,278,780 B2 3/2016 Hassell et al.
9,302,810 B2 4/2016 Cavalcante
2002/0153682 A1 10/2002 Gruber
2003/0020545 A1 1/2003 Joly et al.
2003/0183549 A1 10/2003 Verna et al.
2003/0205495 A1 11/2003 Verna et al.
2004/0050742 A1 3/2004 Gruber
2004/0060844 A1 4/2004 Stahl
2004/0144680 A1 7/2004 Stahl
2005/0183980 A1 8/2005 Fernandez et al.
2006/0070906 A1 4/2006 Verna et al.
2007/0175790 A1 8/2007 Fernandez et al.
2007/0187276 A1 8/2007 Stahl
2007/0187420 A1 8/2007 Gruskin et al.
2008/0110790 A1 5/2008 McTavish et al.
2008/0116099 A1 5/2008 Garcia
2008/0116100 A1 5/2008 Hassell et al.
2010/0000900 A1* 1/2010 Hassell ..... B65D 21/046 206/509
2010/0084304 A1 4/2010 Cavalcante
2011/0037237 A1* 2/2011 Hassell ..... 280/79.11
2012/0193260 A1* 8/2012 Baltz et al. ..... 206/503
2012/0211390 A1* 8/2012 Hassell ..... B65D 1/34 206/510
2012/0241349 A1 9/2012 Koefelda et al.
2013/0008814 A1 1/2013 Ritzberger et al.
2013/0200915 A1 8/2013 Panagas
2015/0076028 A1 3/2015 Baltz et al.
2016/0007737 A1 1/2016 Clark et al.
2016/0009448 A1 1/2016 Hassell

FOREIGN PATENT DOCUMENTS

CA 2408247 A1 11/2001
CA 2448920 A1 7/2004
DE 20013147 U1 12/2000
DE 102010013284 A1 9/2011
EP 1911628 A1 4/2008
EP 1911682 A1 4/2008
EP 2284089 A2 2/2011
FR 2266638 A1 10/1975
FR 2391115 A1 12/1978
FR 2756706 A1 6/1998
FR 2851552 A1 8/2004

(56) References Cited

FOREIGN PATENT DOCUMENTS

| | | | |
|---|---|---|---|
| GB | 1203403 | A | 8/1970 |
| JP | 07187269 | A | 7/1995 |
| WO | 9903745 | A1 | 1/1999 |
| WO | 0130660 | A1 | 5/2001 |
| WO | 02094665 | A1 | 11/2002 |
| WO | 03039980 | A1 | 5/2003 |

* cited by examiner

BAKERY TRAY

BACKGROUND

Trays for delivering and displaying baked goods often include a base, front and rear walls extending upward from front and rear edges of the base and the side walls extending upward from side edges of the base. One or both of the front and rear walls are significantly shorter in height than the side walls to provide visibility to the products in the tray. Further, the products may be removed from the tray through the windows formed by the shorter front and rear walls.

Some trays are able to be stacked with one another at variable heights. For example when one tray is stacked on a lower tray in the same orientation as the lower tray, the trays are stacked at one height, while rotating the upper tray 180 degrees relative to the lower tray will stack the trays at a different height. At the higher stacking height, larger (or more) goods can be stacked in the trays. At the lower height smaller (or fewer) goods can be more efficiently stored in the trays. Some trays do not provide the possibility of multiple stacking heights.

SUMMARY

A bakery tray according to one embodiment includes a base a front wall and a rear wall. A pair of opposed side walls extend upward from side edges of the base. Each side wall including a pair of stacking feet and a center projection. Each side wall includes an upper support surface between an inner rail and an outer wall. The inner rail is interrupted by a plurality of pockets arranged to receive the stacking feet and the center projection of an identical tray stacked thereon in a high stack position and in a low stack position. The outer wall includes a plurality of recesses aligned with the plurality of pockets.

The tray may provide a substantially constant height support surface between the pockets. Further, stops may be provided at front and rear ends of the upper support surface.

DETAILED DESCRIPTION OF A PREFERRED EMBODIMENT

Figure 1:
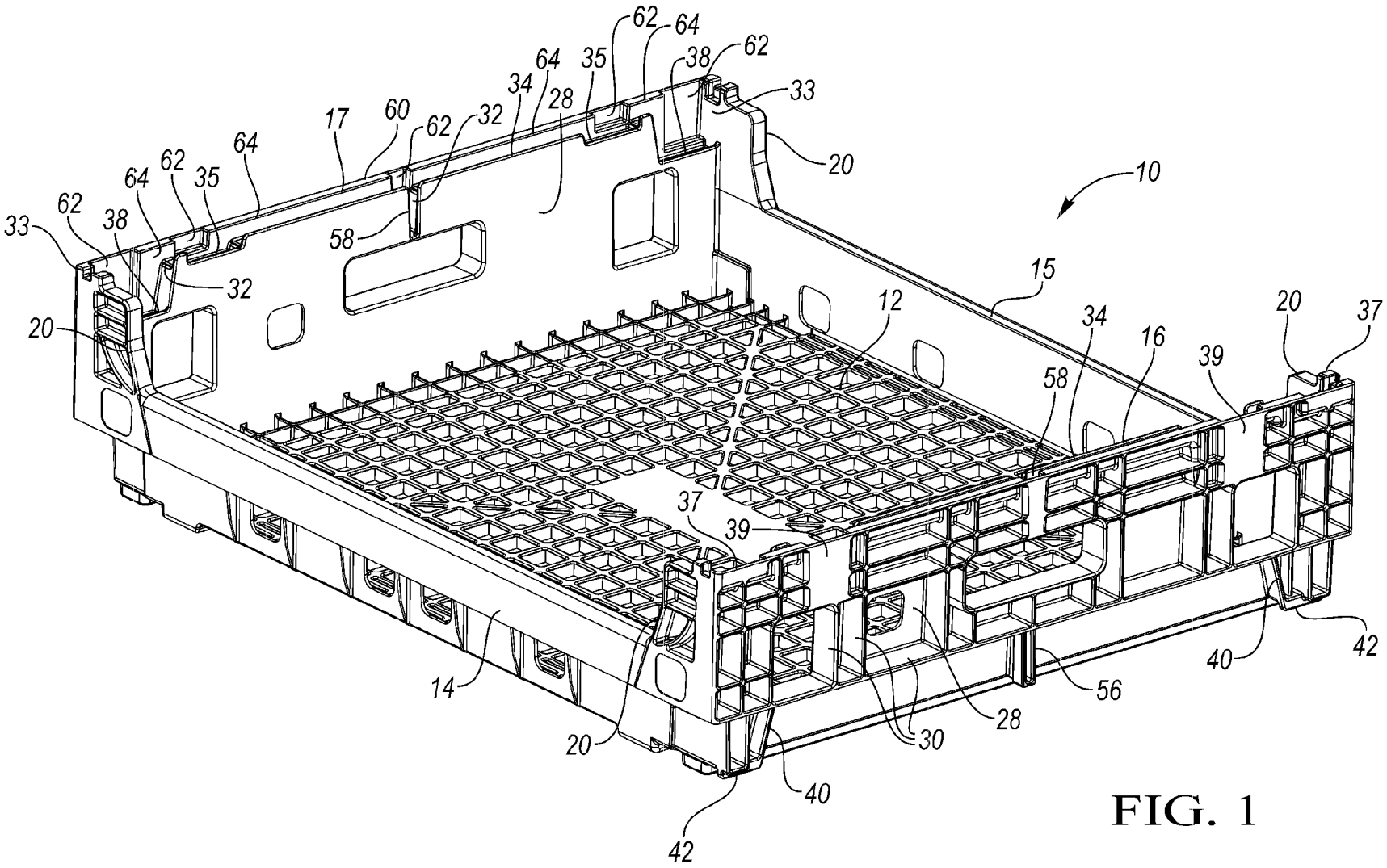
FIG. 1 is a perspective view of a tray according to one embodiment of the present invention.

A bakery tray 10 according to one embodiment of the present invention is shown in FIG. 1. The bakery tray 10 includes a base 12, which may be a grid or lattice of interconnected ribs, a front wall 14, a rear wall 15, and side walls 16 and 17. The front wall 14 and rear wall 15 each include an upper edge, which is lower than the side walls 16, 17. Side flanges 20 extend inwardly into the front wall 14 and rear wall 15 from the side walls 16, 17.

Each of the side walls 16, 17 includes an interior wall portion 28 and a plurality of ribs 30 projecting outwardly therefrom. The side walls 16, 17 include an upper support surface 32 from which projects an inner rail 34, interrupted to accommodate closely-spaced, high feet receiving pockets 35 and widely-spaced low feet receiving pockets 38 on side wall 17 and widely-spaced, high feet receiving pockets 37 and closely-spaced, low feet receiving pockets 39 on side wall 16. An upper edge of the interior wall portion 28 of the side walls 16, 17 includes a chamfered portion 36 providing a recess.

Figure 2:
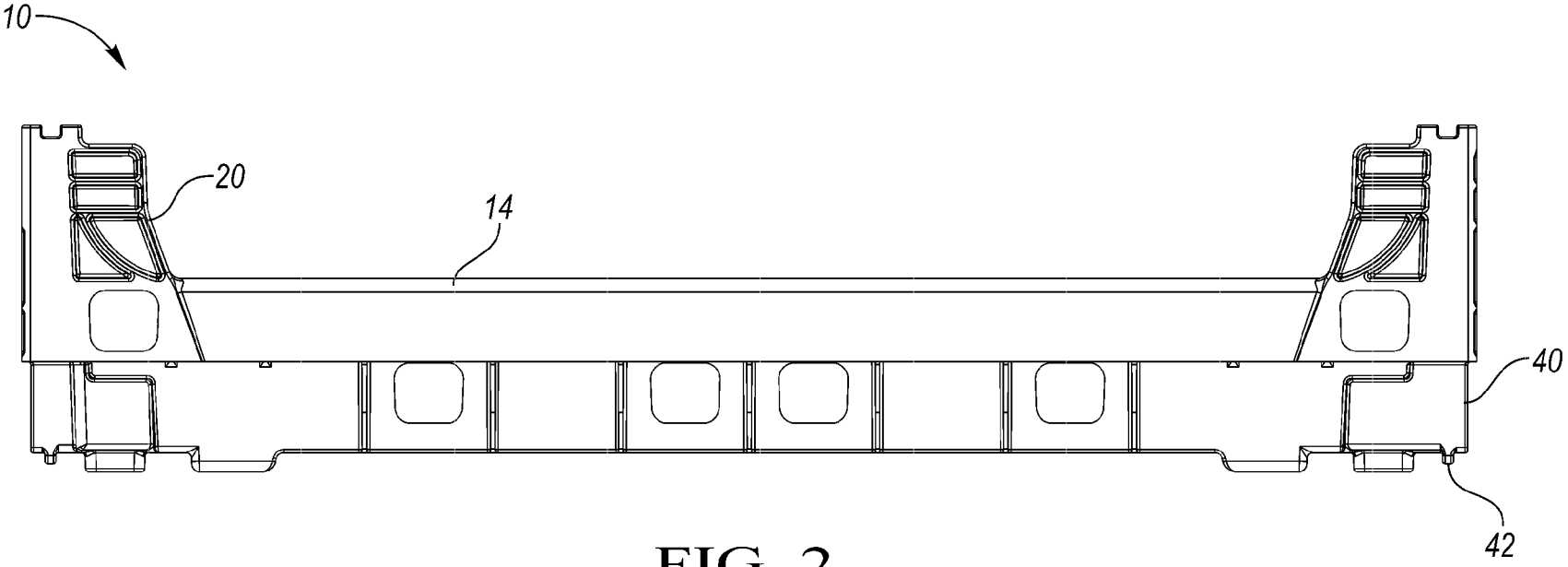
FIG. 2 is a front view of the tray of FIG. 1.

The side wall 16 includes a pair of widely-spaced feet 40 each having an outer rib 42 projecting downwardly from a position spaced inwardly of an outer edge thereof (see FIG. 2). The feet 40 are generally aligned with the high feet receiving pockets 37. The side wall 16 includes a lower wall portion 44 (or drag rail) from which the feet 40 project outwardly. A channel 46 is defined inwardly of the lower wall portion 44.

Figure 10:
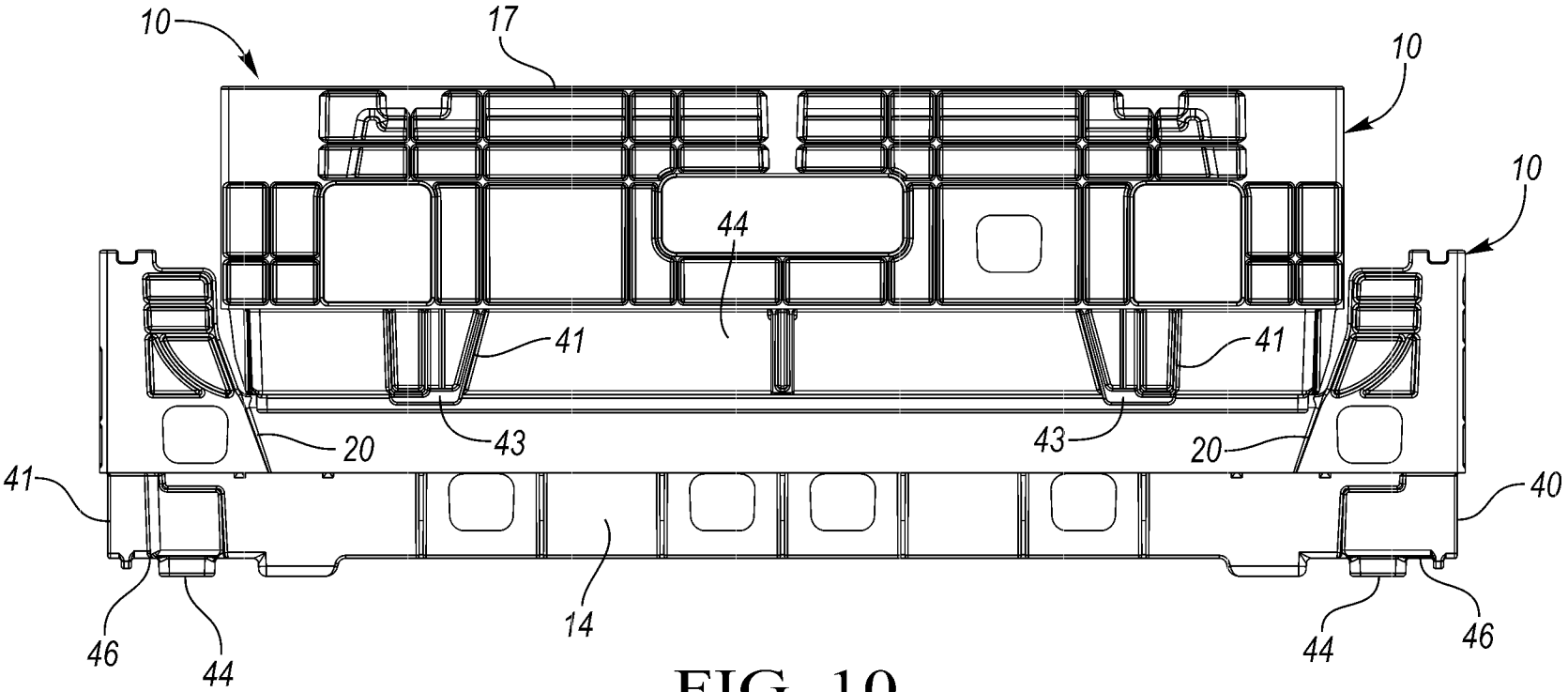
FIG. 10 shows the trays in a cross stacked position.

The side wall 17 is shown more clearly in FIG. 10. The side wall 17 includes a pair of closely-spaced feet 41 each having an outer rib 43 projecting downwardly from an outer edge thereof. The feet 41 are generally aligned with the high feet receiving pockets 35. The side wall 17 includes a lower wall portion 44 (or drag rail) from which the feet 41 project outwardly. A channel 46 is defined inwardly of the lower wall portion 44.

Referring back to FIG. 1, on the side walls 16, 17 in the center between the feet, a center projection 56 protrudes outwardly. The center projection 56 is aligned with a center recess 58 on each side wall 16, 17.

Each side wall 16, 17 includes an outer wall portion 60 spaced outward from the inner rail 34. The outer wall portion 60 includes a plurality of alternating recesses 62 and projections 64, with the recesses 62 aligned with the pockets 35, 37, 38, 39 and 58. An upper channel 66 is defined between the inner rail 34 and the outer wall portion 60, and more particularly between the inner rail 34 and the projections 64.

Figure 3:
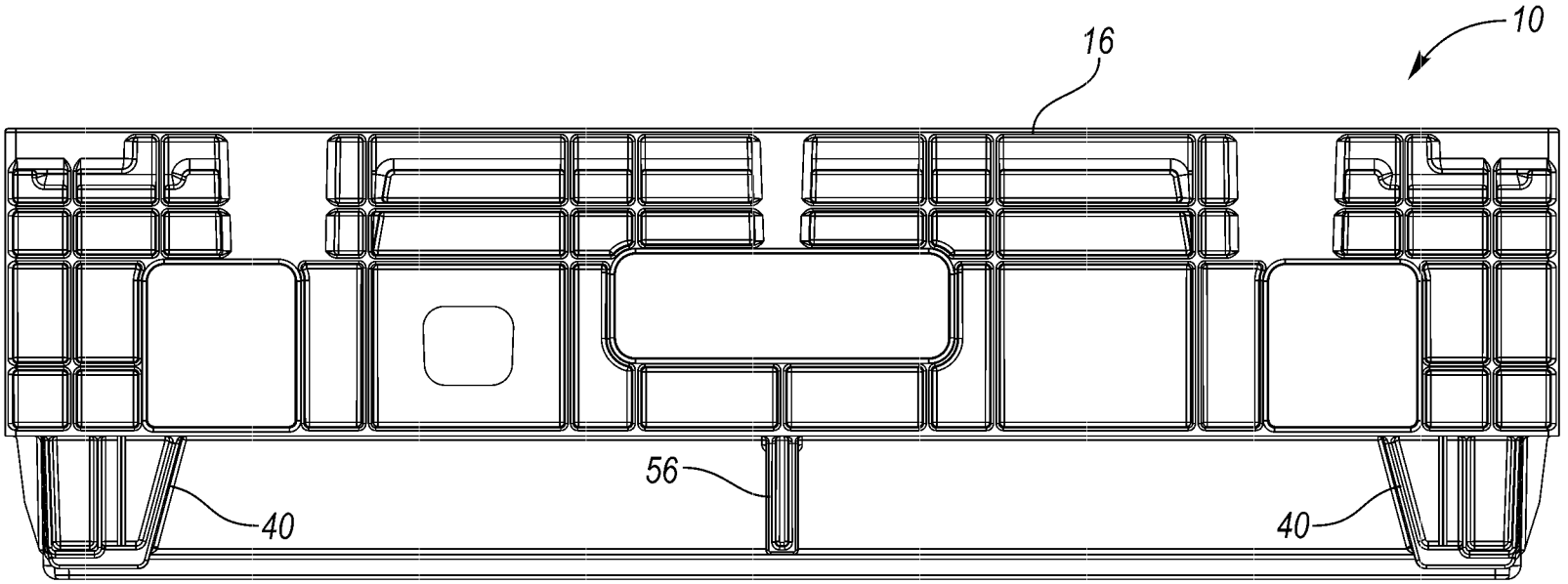
FIG. 3 is a side view of the tray of FIG. 1.

FIG. 2 is a front view of the tray 10. FIG. 3 is a side view of the tray 10 showing side wall 16.

Figure 4:
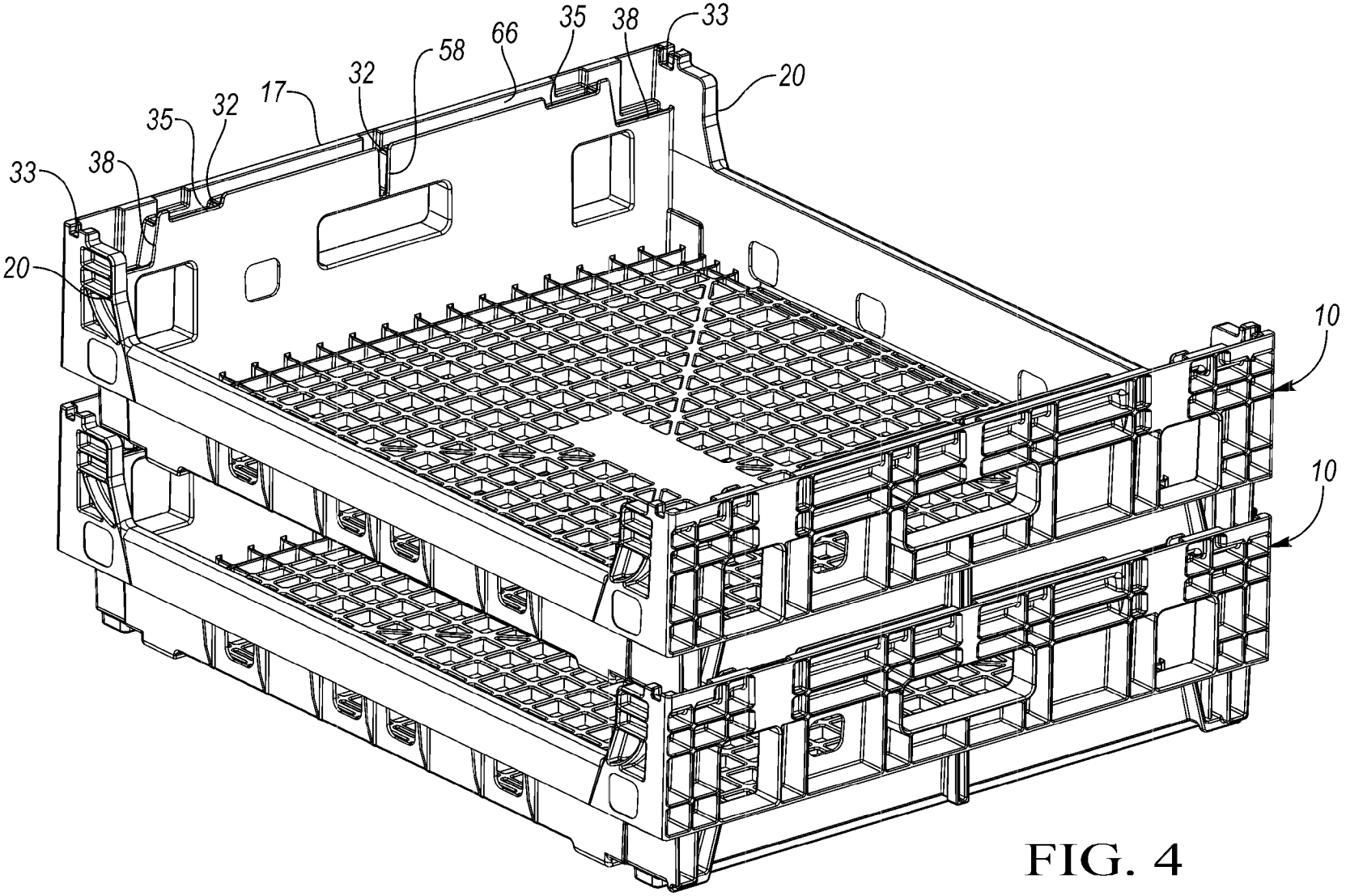
FIG. 4 shows two of the trays of FIG. 1 in a high stacked position.

FIG. 4 is a perspective view of two trays 10 stacked in the high stack position (with the upper tray 10 oriented the same as the lower tray 10—alternatively, the high stack position could be provided when the upper tray 10 rotated 180 degrees relative to the lower tray 10). As can be seen in FIG. 4, on the side wall 17, the upper support surface 32 between the center recess 58 and the low feet receiving pockets 38 (including the high feet receiving pockets 35) is the same and substantially constant. Inner surfaces of the side flanges 20 provide stops 33 at longitudinal ends of the channel 66.

Figure 5:
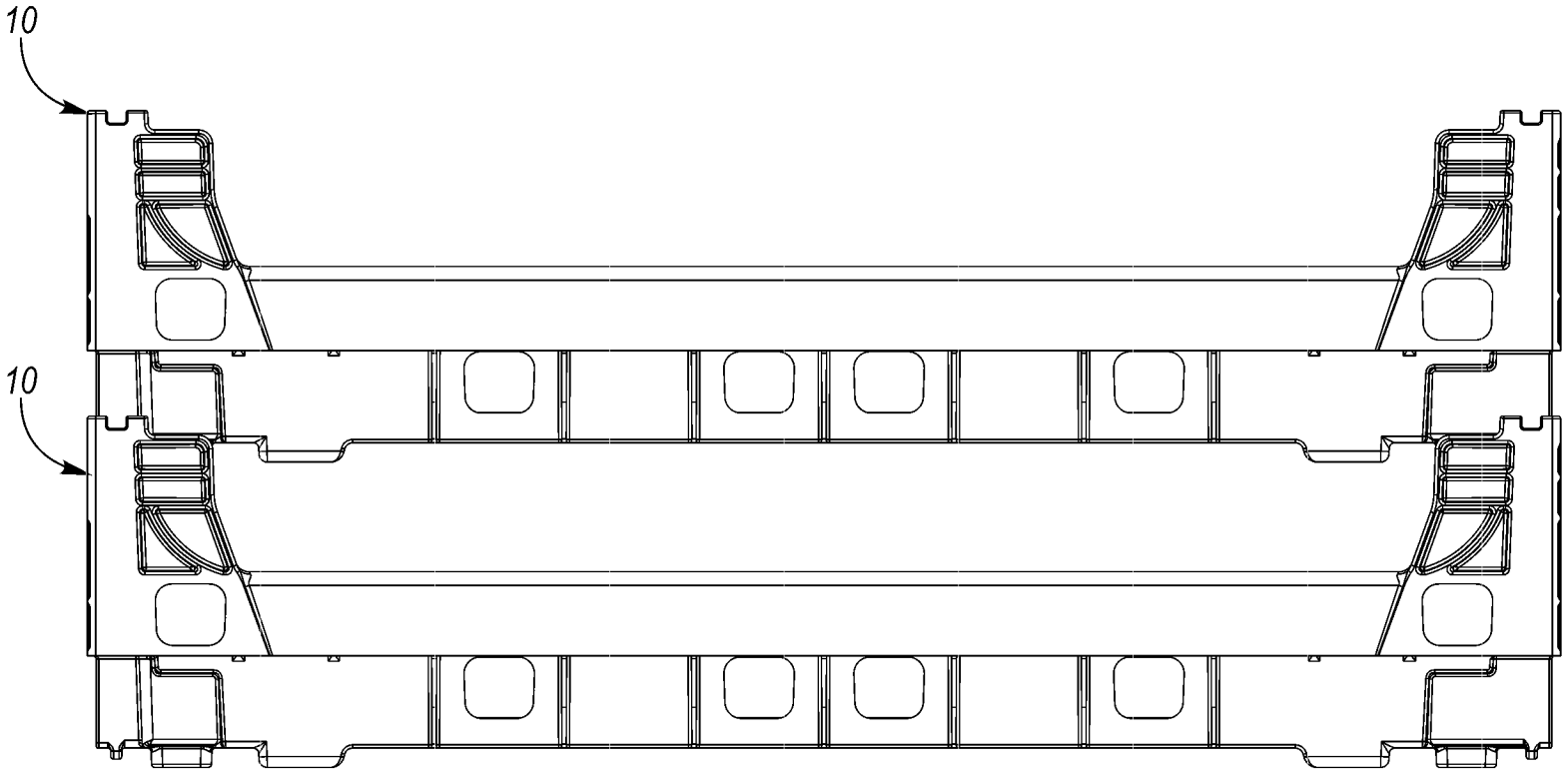
FIG. 5 is a front view of the trays of FIG. 4.
Figure 6:
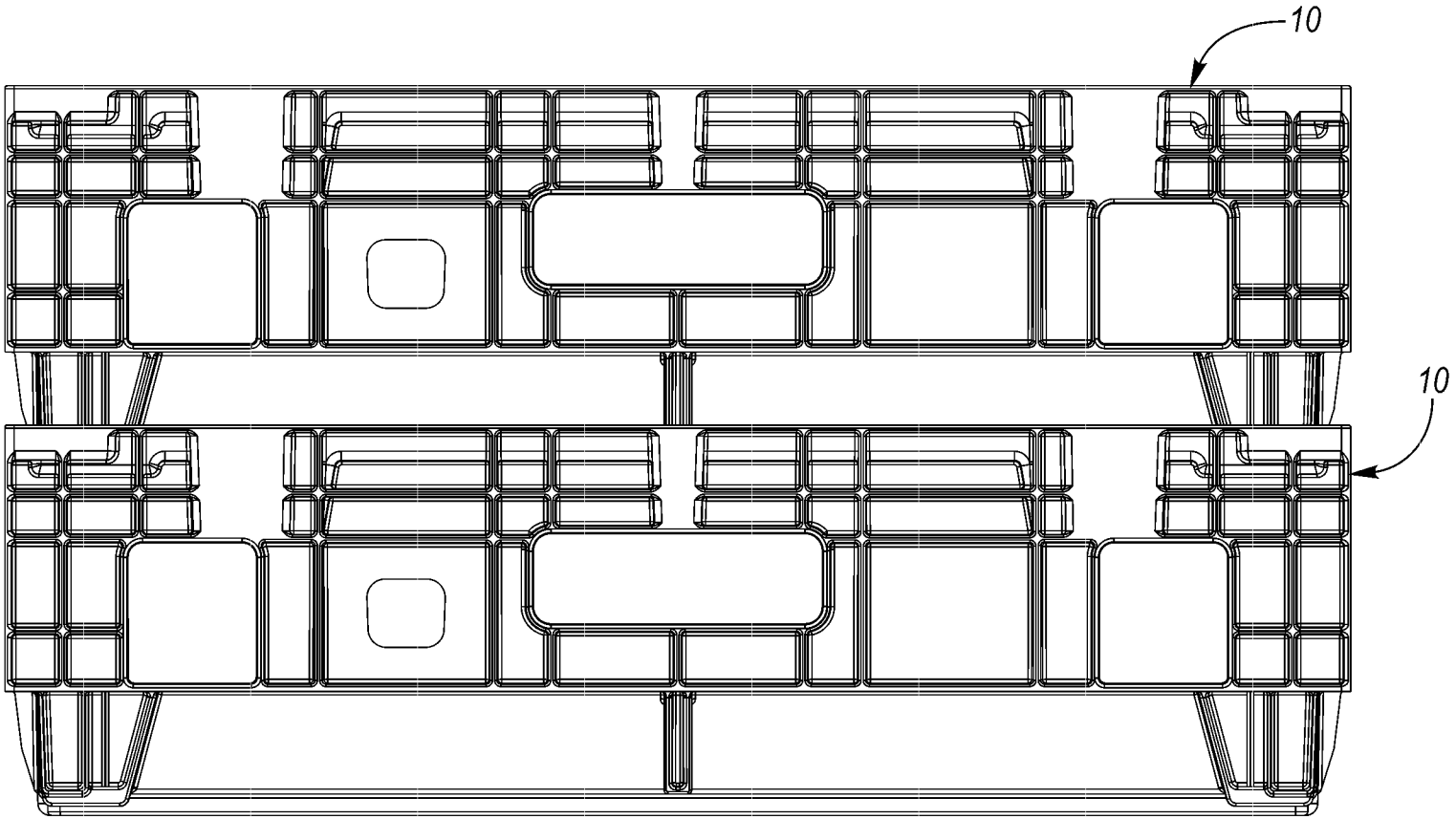
FIG. 6 is a side view of the trays of FIG. 4.

FIG. 5 is a front view of the trays 10 of FIG. 4. FIG. 6 is a side view of the trays 10 of FIG. 4.

Figure 7:
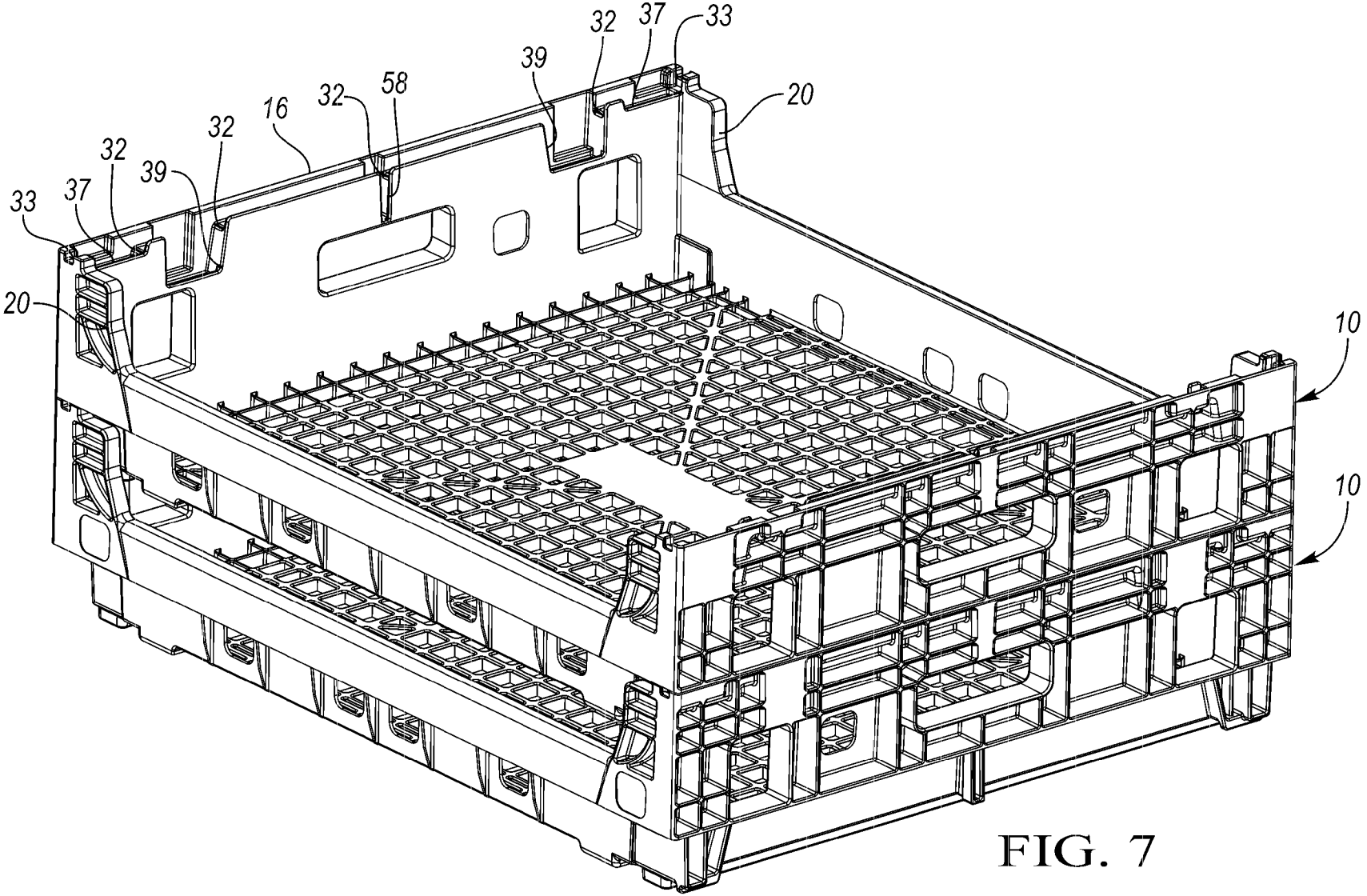
FIG. 7 shows the trays of FIG. 4 in a low stacked position.

FIG. 7 is a perspective view of two trays 10 stacked in the low stack position (with the upper tray 10 rotated 180 degrees relative to the lower tray 10). As can be seen in FIG. 7, on the side wall 16, the upper support surface 32 between the center recess 58 and the low feet receiving pockets 39, and outward of the low feet receiving pockets 39 (including the high feet receiving pockets 37) is the same and substantially constant. Inner surfaces of the side flanges 20 provide stops 33 at longitudinal ends of the channel 66.

Figure 8:
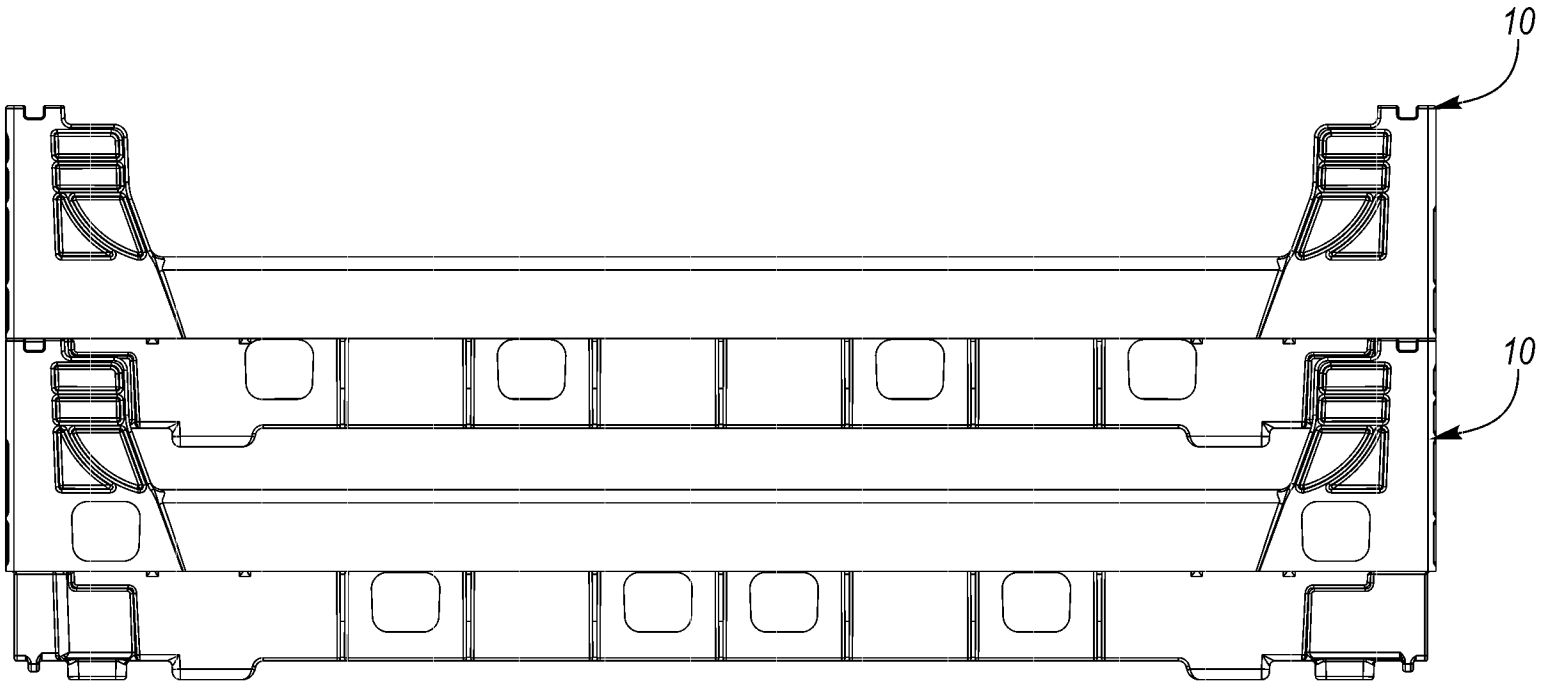
FIG. 8 is a front view of the trays of FIG. 7.
Figure 9:
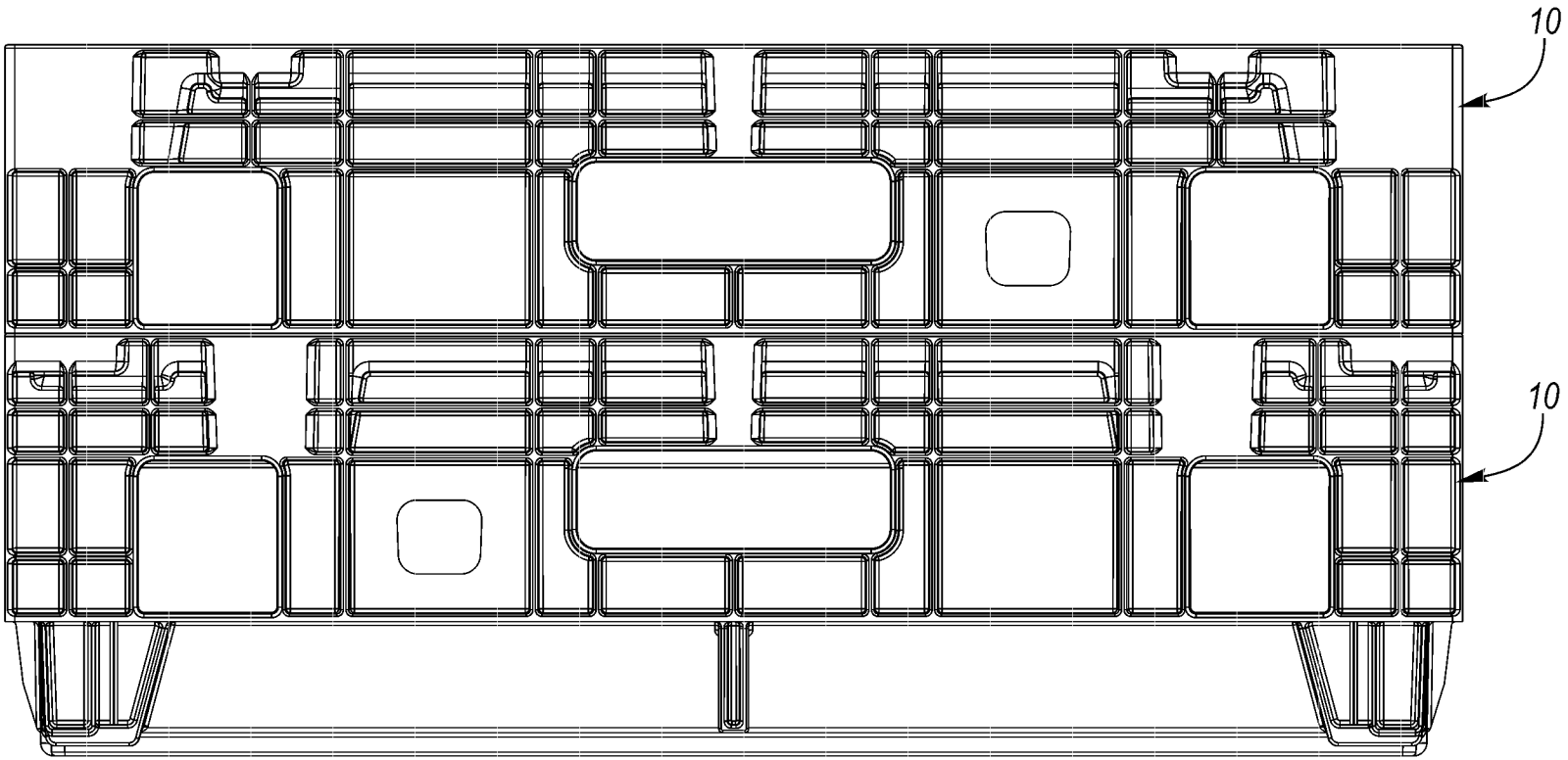
FIG. 9 is a side view of the trays of FIG. 7.

FIG. 8 is a front view of the trays 10 of FIG. 7. FIG. 9 is a side view of the trays 10 of FIG. 7.

Figure 11:
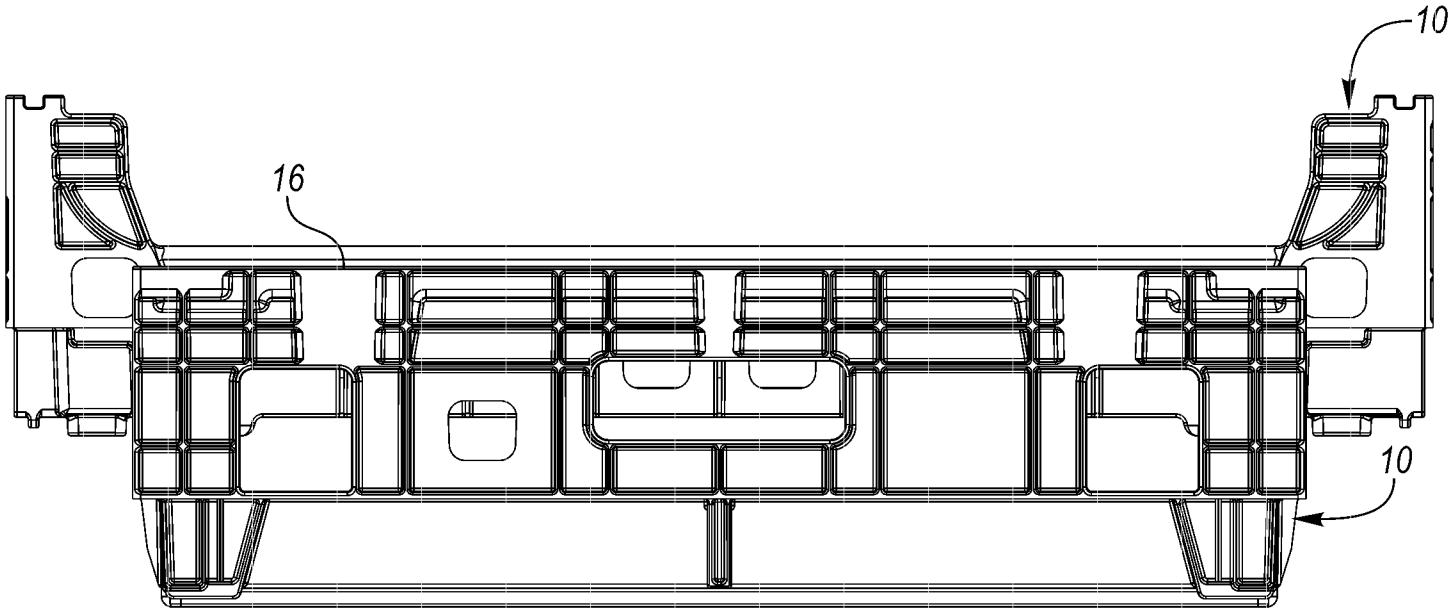
FIG. 11 is a side view of the trays of FIG. 10.

FIG. 10 shows the two trays 10, with one rotated 90 degrees relative to the other, such that it is substantially between the side flanges 20 of the front wall 14 (and rear wall 15). This reduces the overall stacking height when the trays 10 are empty. FIG. 11 is a side view of the trays 10 of FIG. 10.

Figure 12:
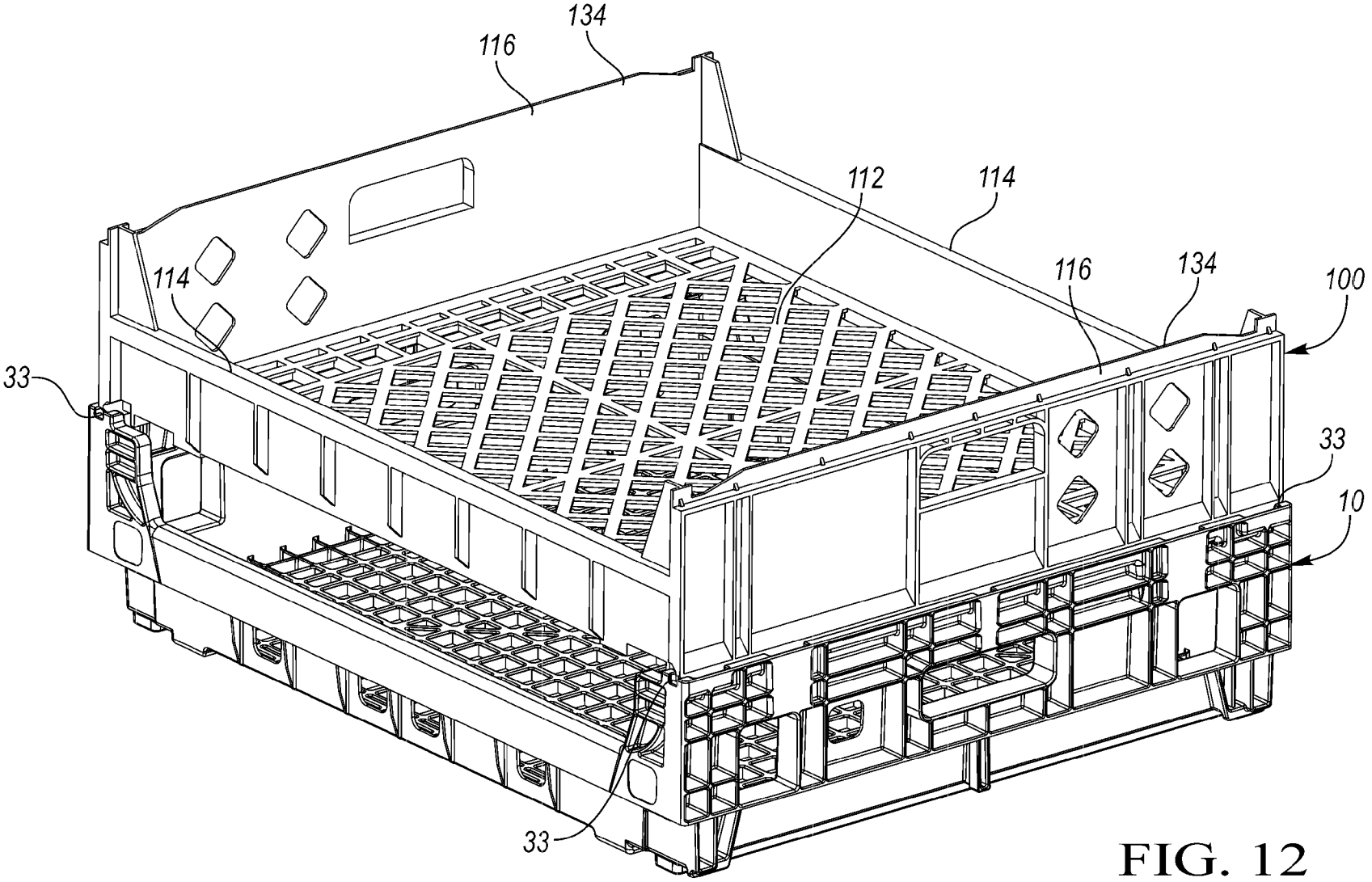
FIG. 12 shows the tray of FIG. 1 with a prior art single position tray stacked thereon.
Figure 13:
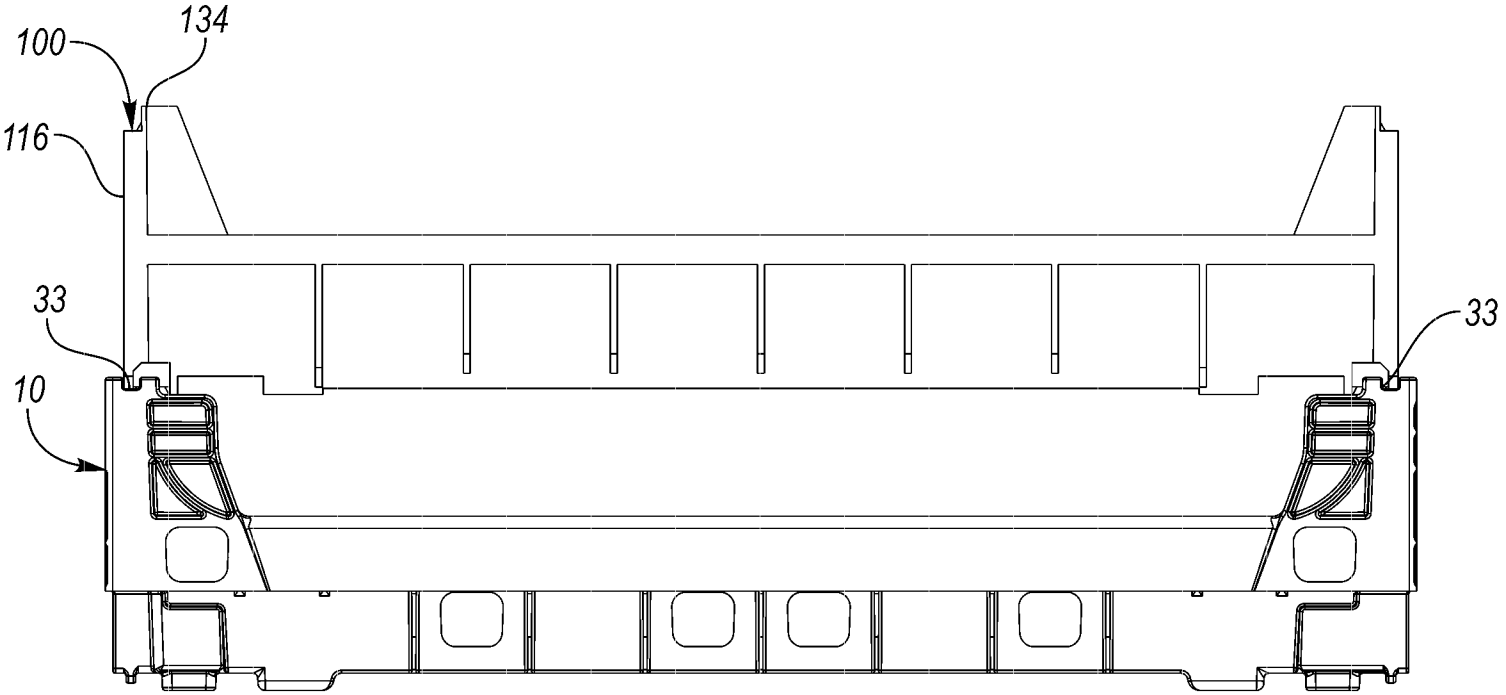
FIG. 13 is a front view of the trays of FIG. 12.

FIG. 12 shows the tray 10 with a prior art tray 100 stacked thereon. The prior art tray 100 includes a base 12, side walls 116 and front and rear walls 114. The prior art tray 100 is a single stacking height tray (with a single stacked position and a single cross stacked position). FIG. 13 is a side view of the trays 10 and 100 of FIG. 12.

Figure 14:
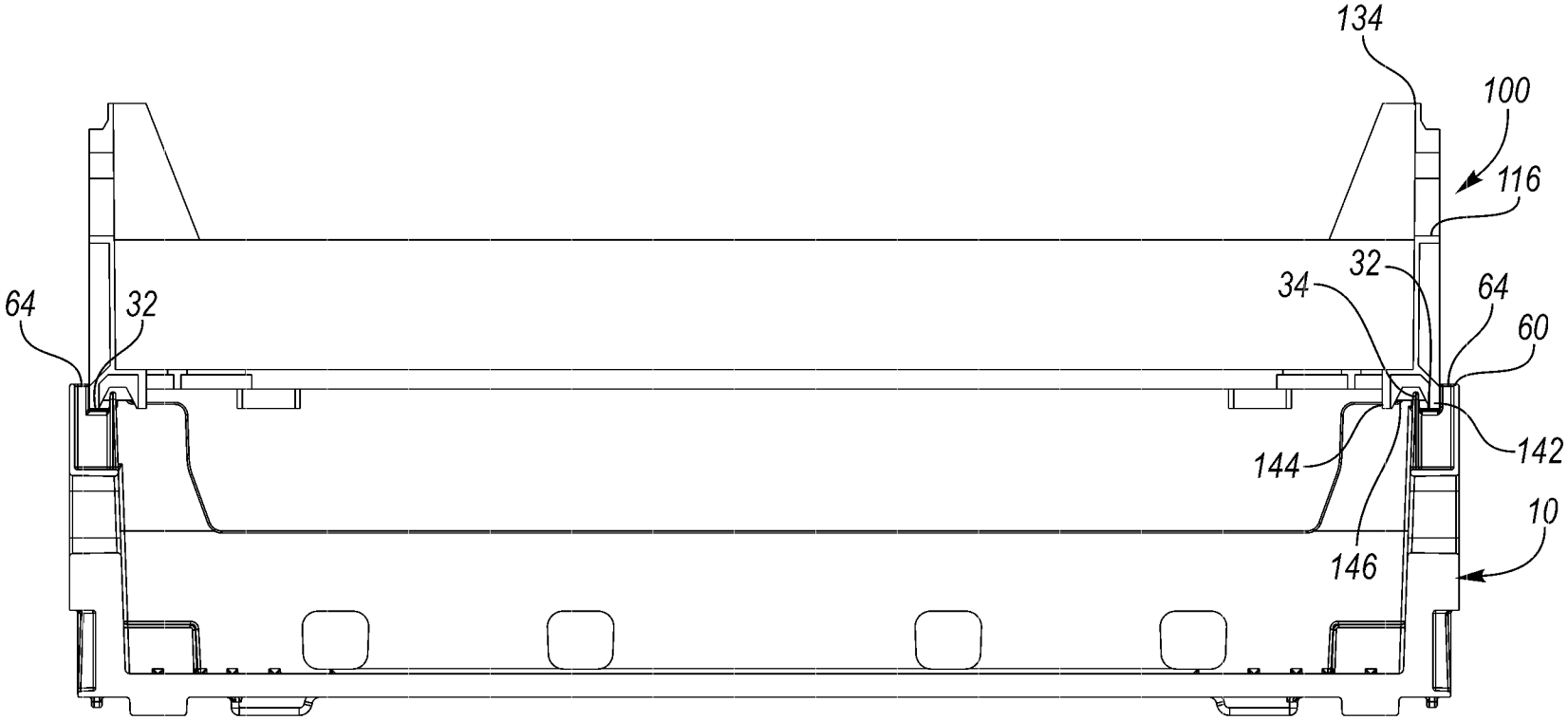
FIG. 14 is a section view through the trays of FIG. 12.

FIG. 14 is a section view through the trays 10 and 100 of FIG. 12. Each side wall 116 of tray 100 includes an upper rail 134. Below each side wall 116, the tray 100 includes an outer rib 142 projecting downward from an outer edge of the tray 100. An inner rib 144 is spaced inward of the outer rib 142 and projects downwardly to define a recess 146 therebetween. When the tray 100 is stacked on the tray 10, the inner rail 134 is received within the recess 146. The outer rib 142 is received between the projections 64 of the lower tray 10 and the inner rail 34 of the lower tray 10.

Figure 15:
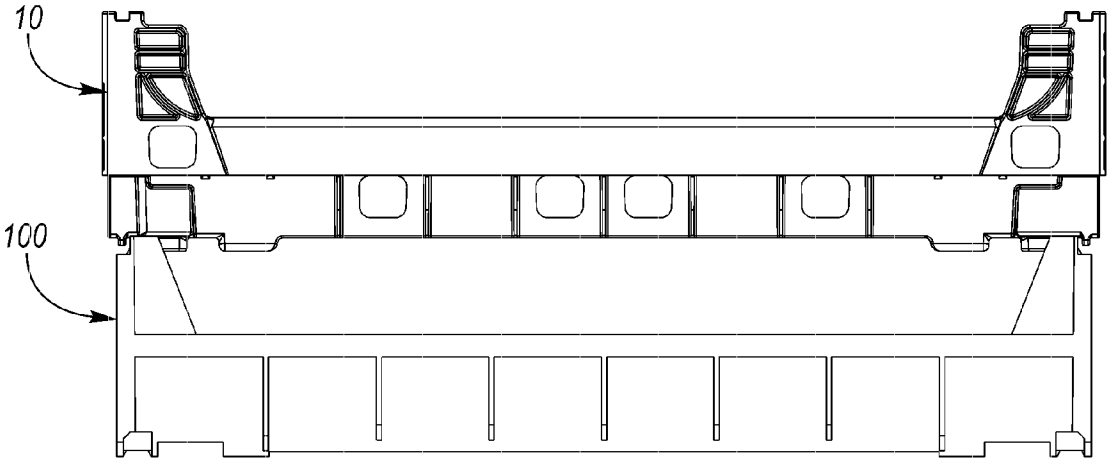
FIG. 15 is a front view of the trays of FIG. 12 with the current tray stacked on top of the prior art tray.
Figure 16:
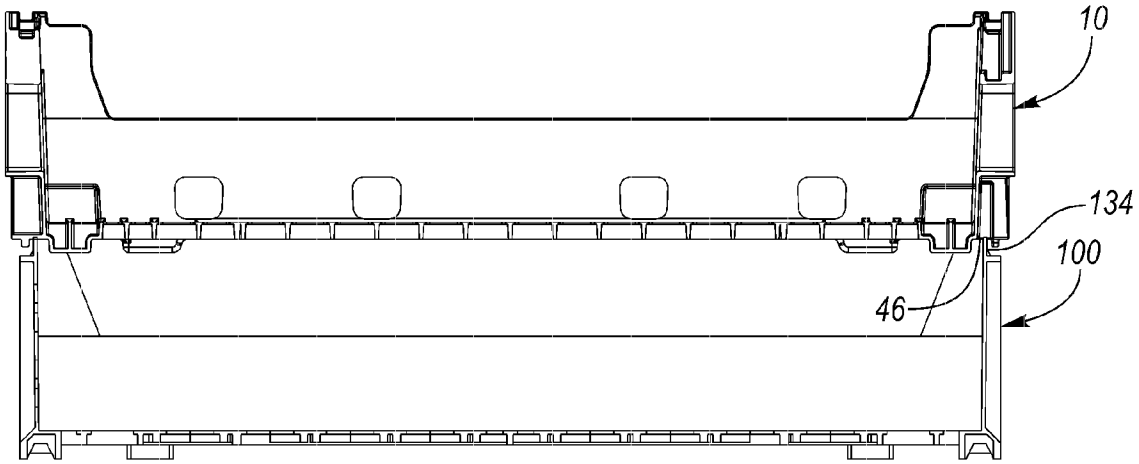
FIG. 16 is a section view of the trays of FIG. 15.
Figure 17:
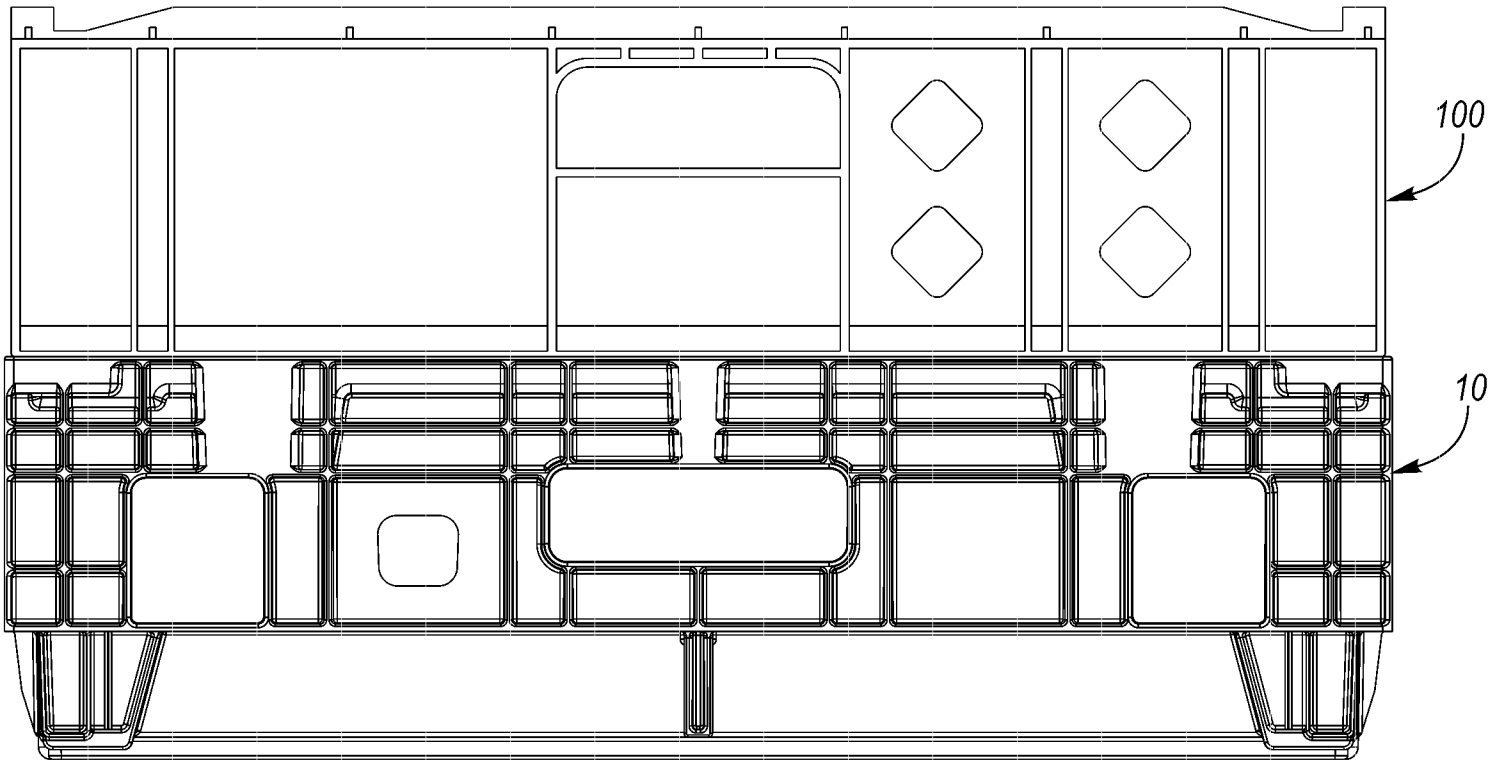
FIG. 17 is a side view of the trays of FIG. 15.

FIGS. 15-17 show the tray 10 stacked on the prior art tray 100. The upper rail 134 of the lower (prior art) tray 100 is received in the recess 146 of the upper tray 10.

Figure 18:
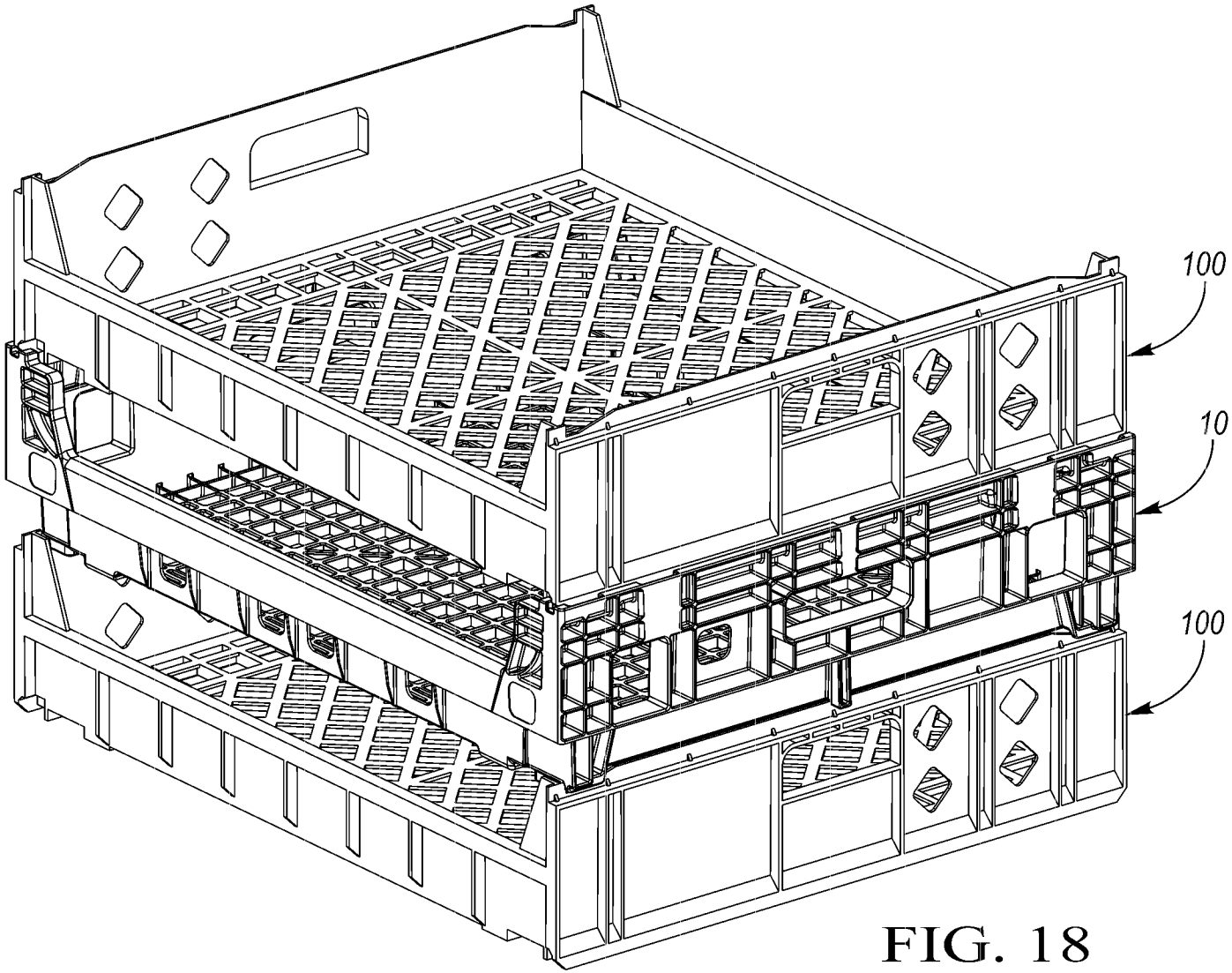
FIG. 18 shows the current tray stacked between two prior art trays.
Figure 19:
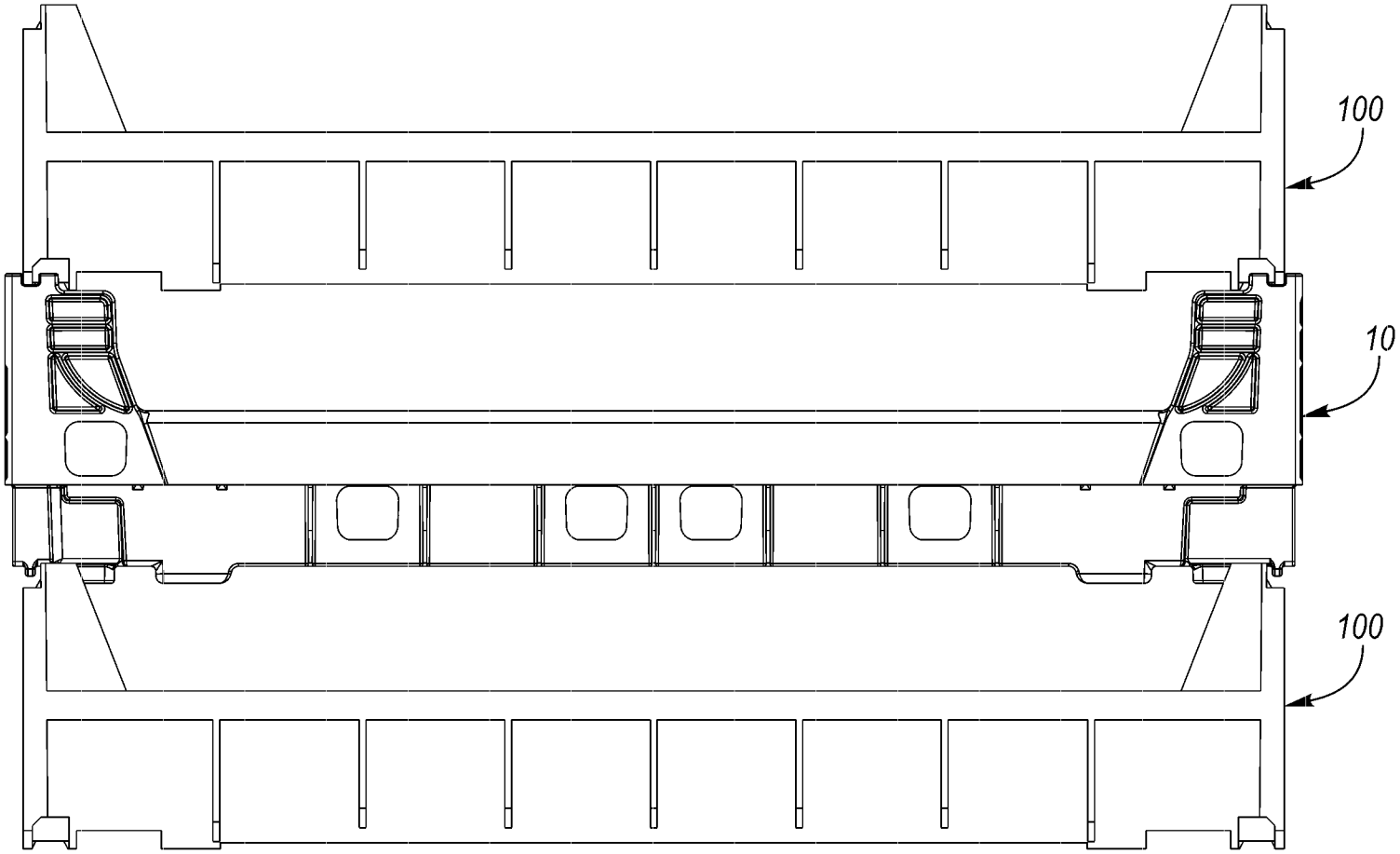
FIG. 19 is a front view of the trays of FIG. 18.
Figure 20:
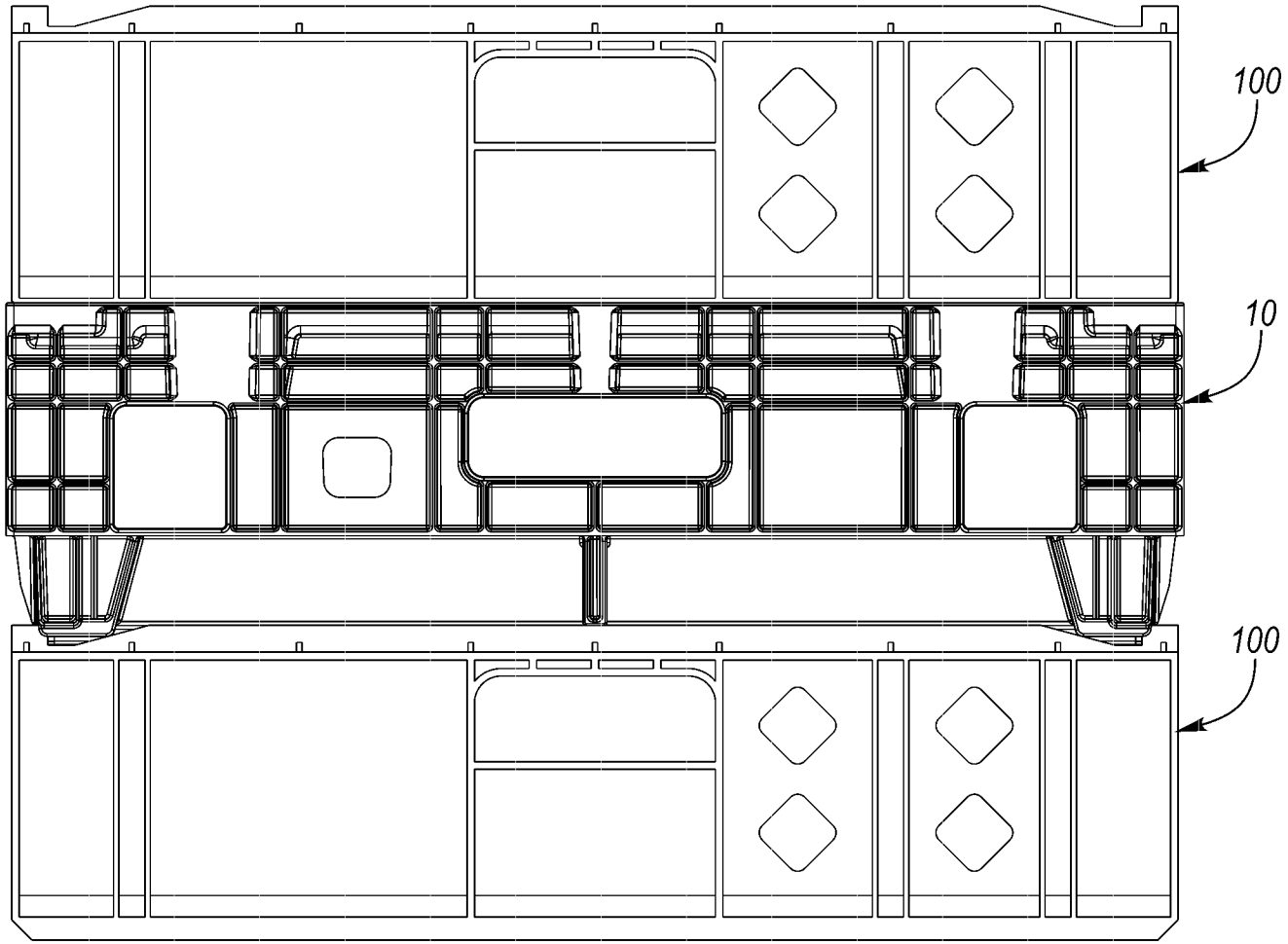
FIG. 20 is a side view of the trays of FIG. 18.
Figure 21:
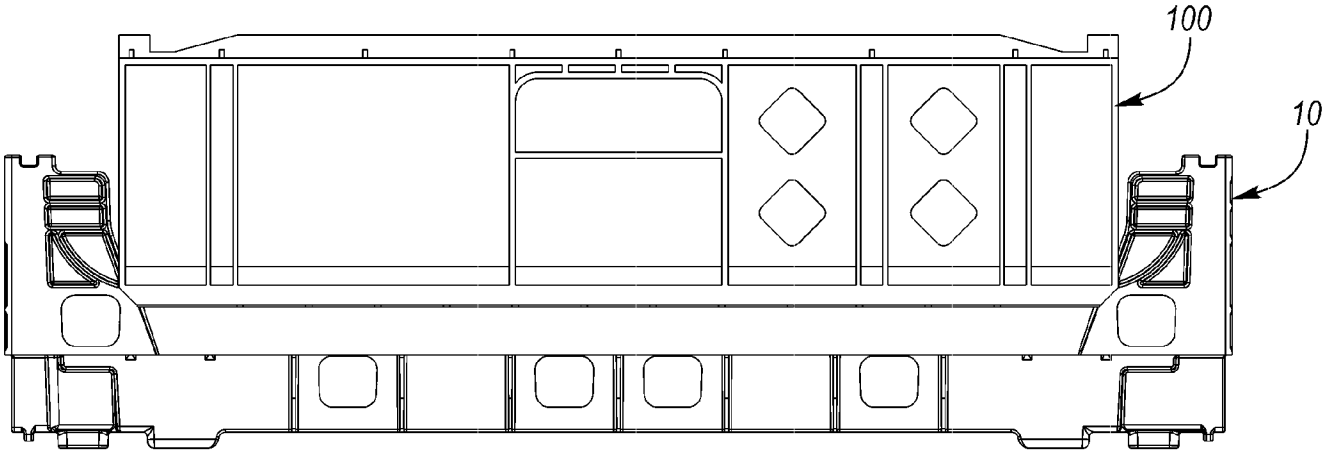
FIG. 21 shows the current tray cross stacked with a prior art tray.
Figure 22:
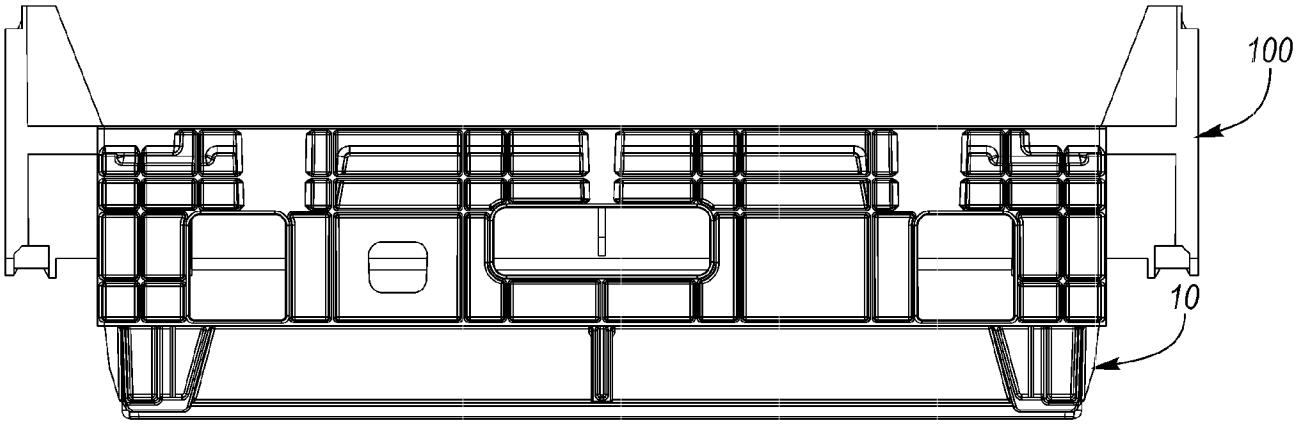
FIG. 22 is a side view of the trays of FIG. 21.

FIGS. 18-20 show that the tray 10 is fully stackable (stackable above and below) the prior art single-height tray 100. FIGS. 21-22 show that the prior art tray 100 can be cross-stacked onto the tray 10, substantially between the side flanges 20, to reduce stacking height when empty.

Figure 23:
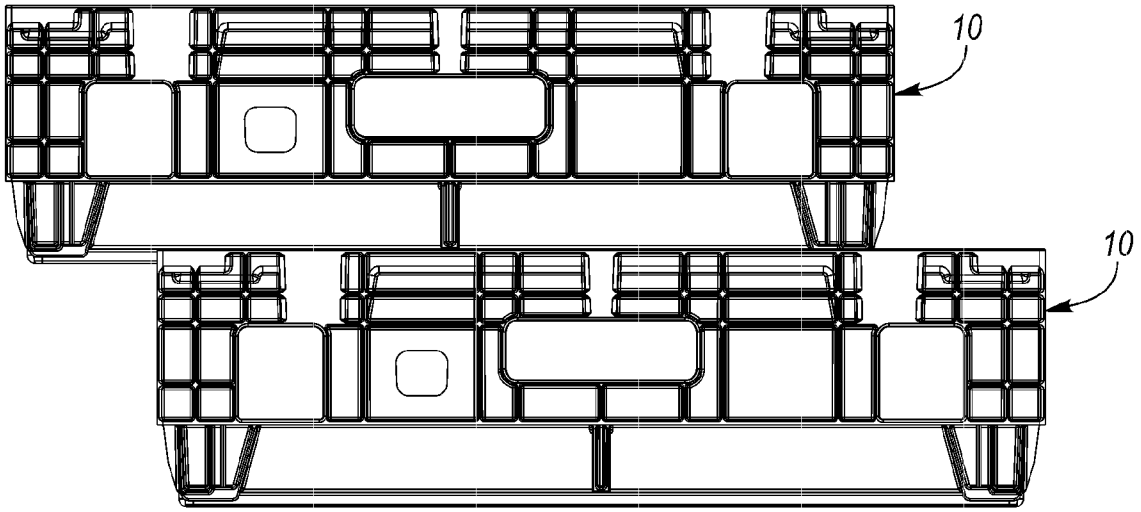
FIG. 23 shows a pair of the trays of FIG. 1 being slide stacked.
Figure 24:
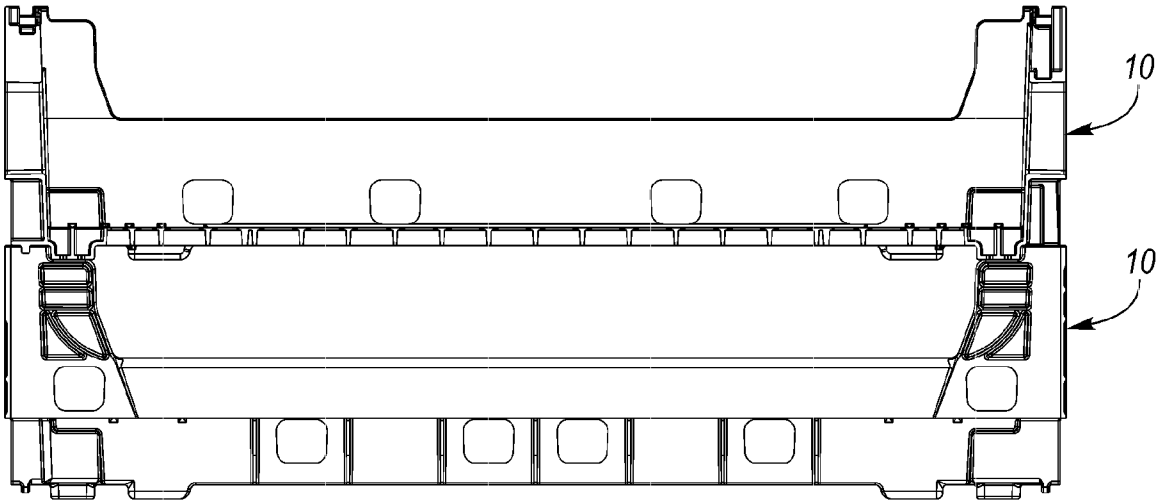
FIG. 24 is a section view through the trays of FIG. 23.
Figure 25:
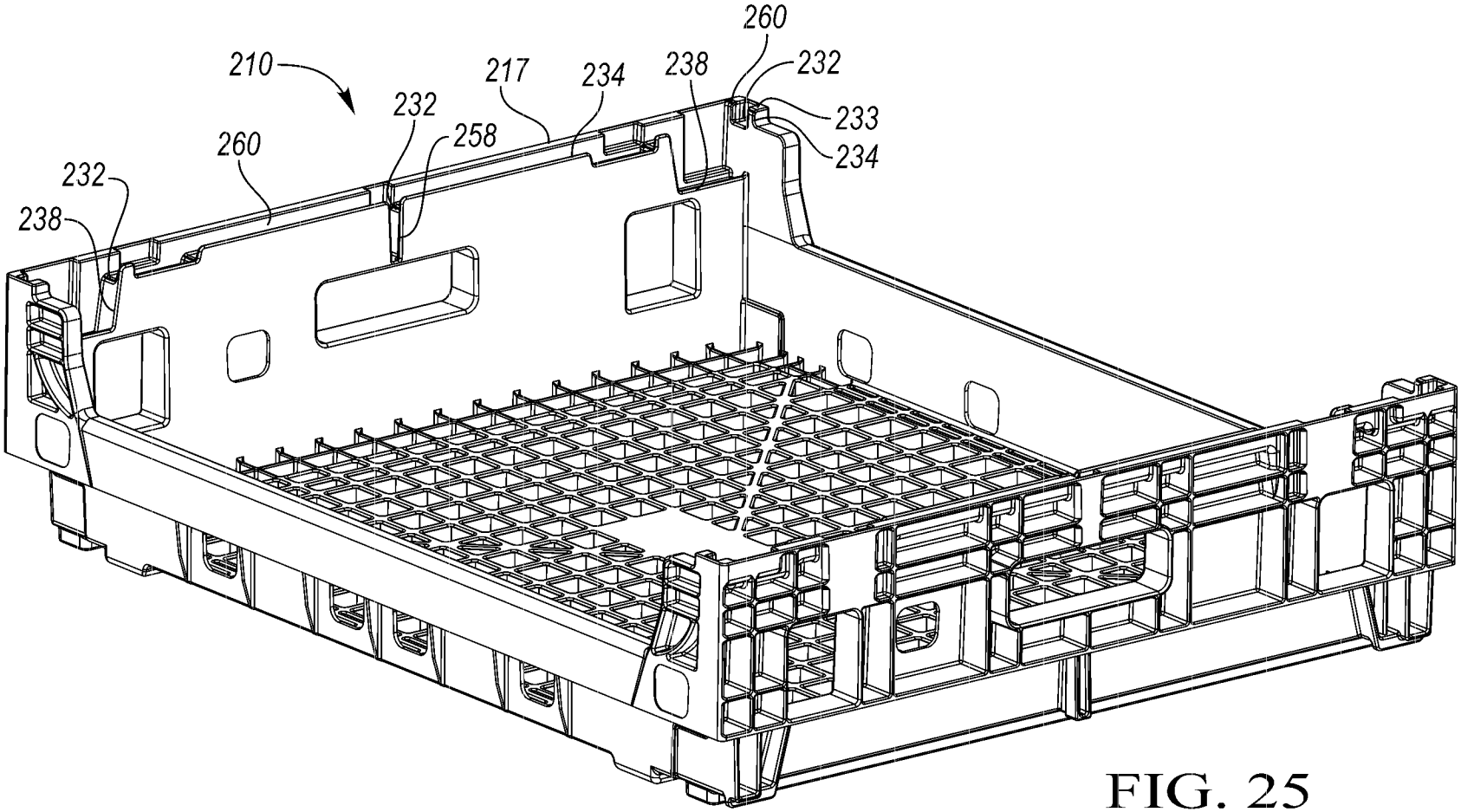
FIG. 25 is a perspective view of a tray according to a second embodiment.
Figure 26:
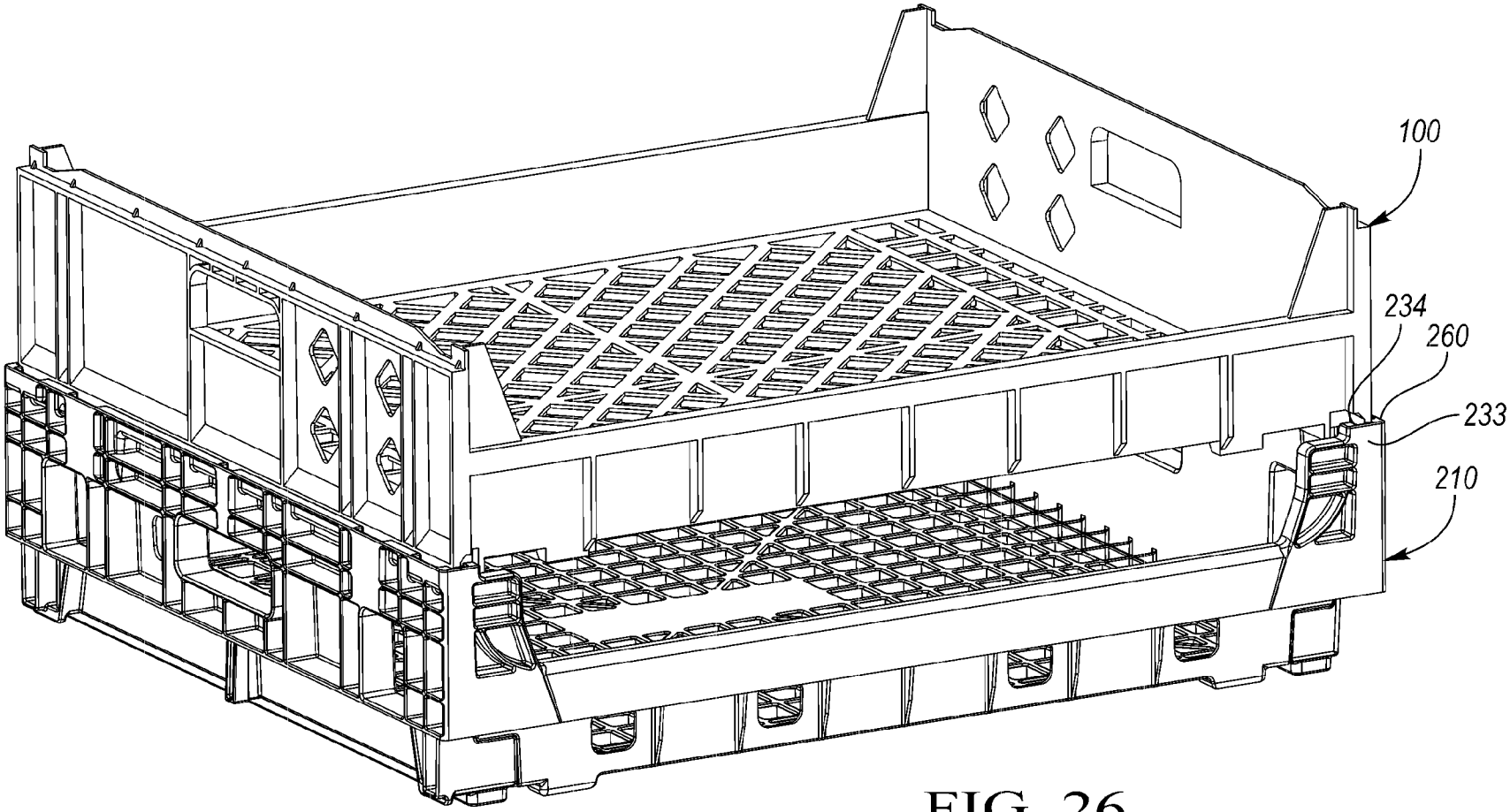
FIG. 26 is a perspective view of the tray of FIG. 25 with the prior art tray stacked thereon.
Figure 27:
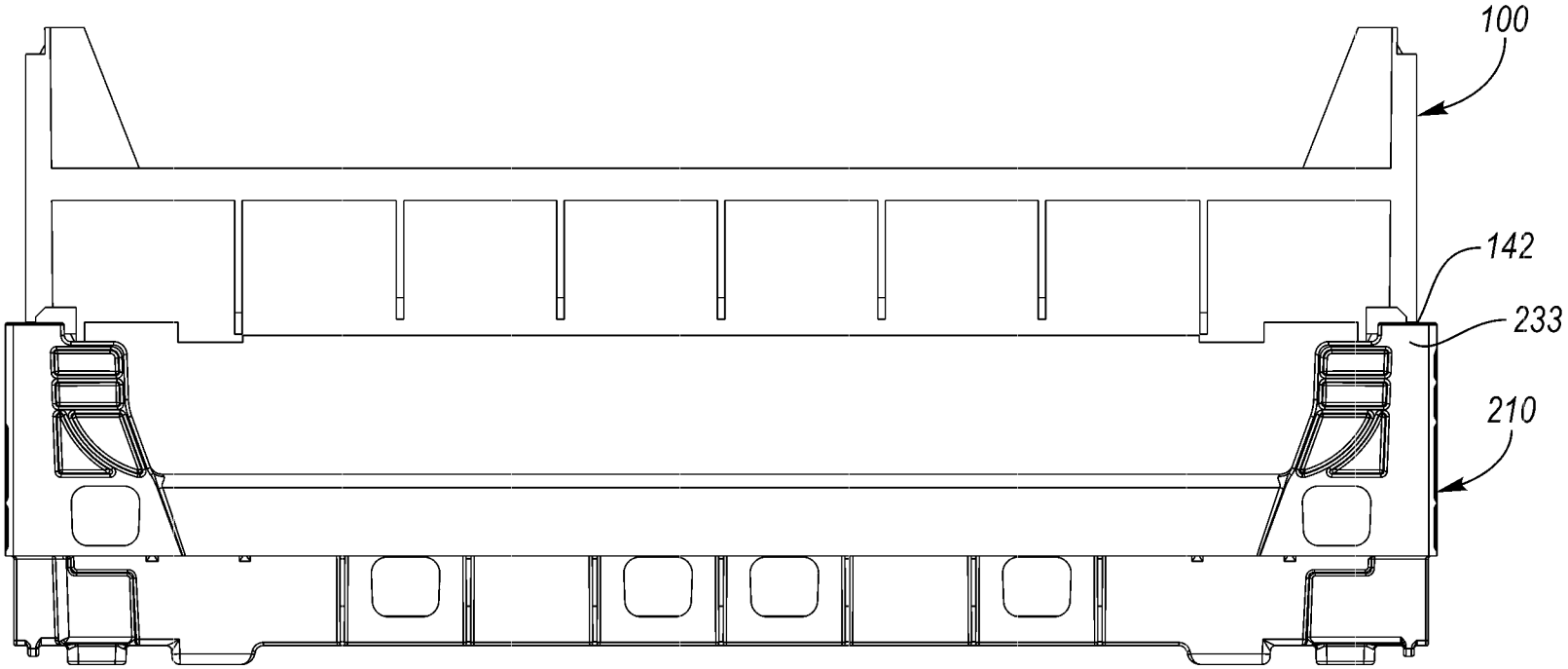
FIG. 27 is a front view of the trays of FIG. 26.

FIG. 23 is a side view showing one tray 10 sliding onto another tray 10. FIG. 24 is a section view through the trays of FIG. 23. When sliding on the bottom tray 10, the stacking feet 40, 41 (outward of the outer rib 42) and center projection 56 slide on the outer wall portion 60 of the bottom tray 10. The stacking feet 40, 41 (inward of the outer rib 42) and center projection 56 slide on the inner rail 34.

The trays 10, 100 are preferably integrally molded as a single piece of plastic.

An alternate tray 210 is shown in FIGS. 25-28. Unless otherwise specified or shown in the Figures, the tray 210 is identical to the tray 10 of FIG. 1. The side walls 216, 217 of the tray 210 have additional pockets for capturing the outer rib 142 (FIG. 14) of the tray 100 at longitudinal ends of the channels 266. On side wall 217, the support surface 232 extends outward of the low stacking feet receiving pockets 238 where there are pockets defined on three sides by the inner rail 234, the outer wall portion 260 (extended across the pockets 238) and the stops 233.

On side wall 216, the support surface 232 also extends into pockets at longitudinal ends of the channel 266. The pockets are defined on three sides by the inner rail 234, the outer wall portion 260 (extended across the pockets 238) and the stops 233.

Figure 28:
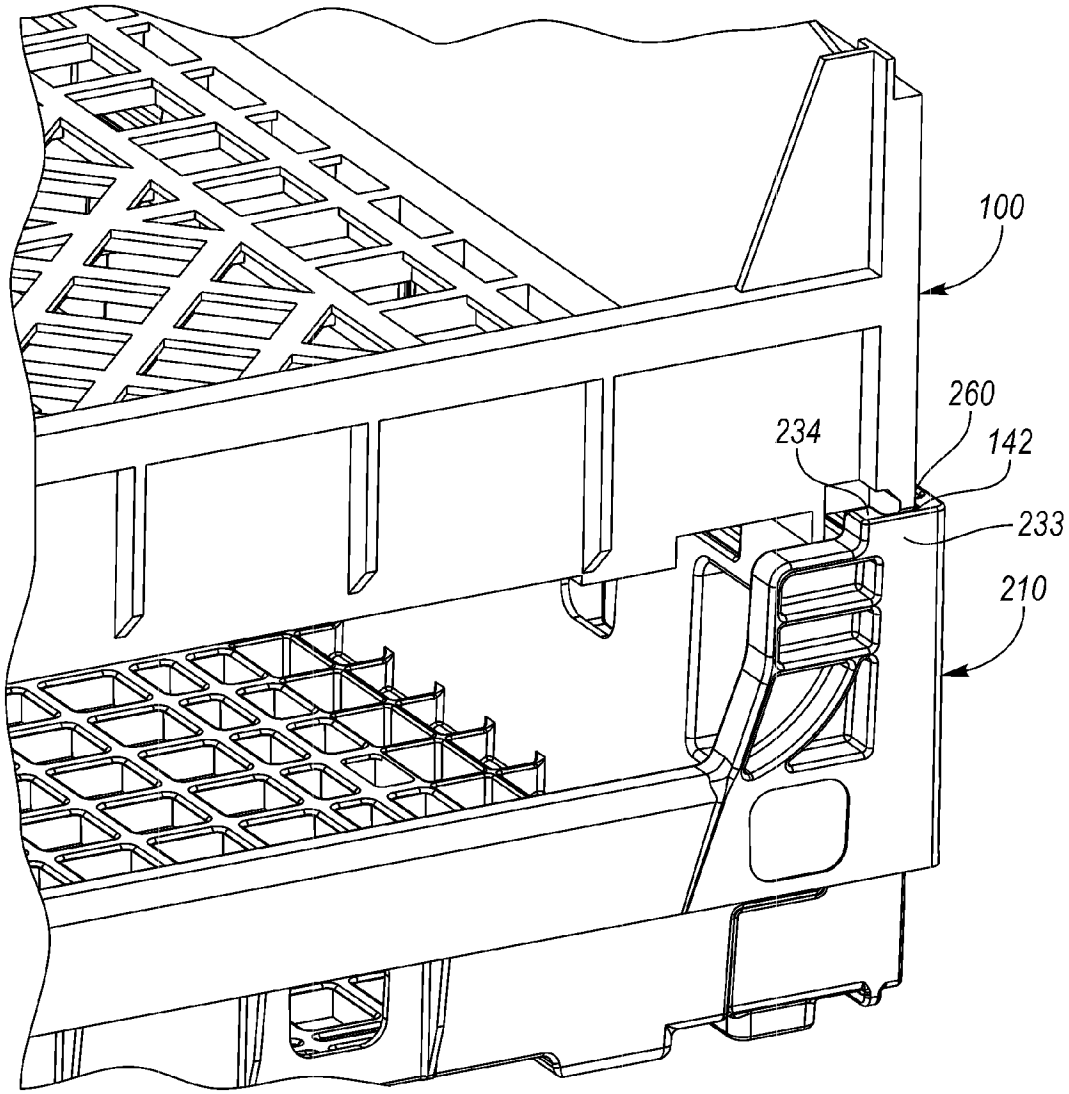
FIG. 28 shows the prior art tray received in one corner of the side wall of FIG. 26.

As shown in FIG. 28, the outer rib 142 of the single height tray 100 is captured in the pocket at the longitudinal end of the channel 266 between the inner rail 234, the outer wall portion 260 and the stops 233

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

The invention claimed is:

1. A bakery tray comprising:

a base;

a front wall extending upward from a front edge of the base;

a rear wall extending upward from a rear edge of the base; and a pair of opposed side walls extending upward from side edges of the base, each side wall including a pair of stacking feet and a center projection, each side wall including an upper support surface between an inner rail and an outer wall, the inner rail interrupted by a plurality of pockets arranged to receive the stacking feet and center projection of an identical bakery tray stacked thereon in a high stack position and in a low stack position, the outer wall including a plurality of recesses aligned with the plurality of pockets, wherein the recesses do not extend down as far as a bottom surface of the plurality of pockets.

2. The bakery tray of claim 1 wherein the stacking feet on one of the pair of opposed side walls are closer to one another than the stacking feet on the other of the pair of opposed side walls.

3. The bakery tray of claim 1 wherein a channel is defined between the inner rail and the outer wall, the channel defined at longitudinal ends by stops aligned with the front and rear walls of the bakery tray.

4. The bakery tray of claim 1 wherein the front wall is shorter than the side walls.

5. The bakery tray of claim 1 wherein the plurality of pockets arranged to receive the stacking feet are stacking feet pockets and the pocket arranged to receive the center projection is a center pocket, and wherein for each side wall the upper support surface between one of the stacking feet pockets and the center pocket is the same height as the upper support surface between the other of the stacking feet pockets and the center pocket.

6. The bakery tray of claim 5 wherein on one of the side walls, the upper support surface outward of the stacking feet pockets is the same height as the upper support surface between the stacking feet.

7. In combination:

a first bakery tray comprising:

a base;

a front wall extending upward from a front edge of the base;

a rear wall extending upward from a rear edge of the base; and a pair of opposed side walls extending upward from side edges of the base, wherein the front wall is shorter than the side walls, each side wall including a pair of stacking feet and a center projection, each side wall including an upper support surface between an inner rail and an outer wall, the inner rail interrupted by a plurality of stacking feet pockets arranged to receive the stacking feet of an identical bakery tray stacked thereon in a high stack position and in a low stack position, the plurality of stacking feet pockets including a pair of high pockets and a pair of low pockets, the inner rail interrupted by a center pocket arranged to receive the center projection of the identical bakery tray stacked thereon in the high stack position and in the low stack position, wherein for each side wall the upper support surface between the stacking feet pockets and the center pocket is the same height as the upper support surface between the stacking feet pockets and immediately adjacent ones of the stacking feet pockets; and a second tray stacked on the first tray, wherein the second tray is a single stacking height tray, the single stacking height tray including a base, side walls, front and rear walls, the single stacking height tray further including an outer rib and an inner rib projecting downward from an outer edge of the single stacking height tray, the inner rail of the first bakery tray received between the outer rib and the inner rib of the single height tray.

8. The bakery tray and the single stacking height tray of claim 7, wherein the single stacking height tray does not include stacking feet or pockets for receiving stacking feet.

9. The combination of claim 7 wherein the outer wall of the first bakery tray includes a plurality of recesses aligned with the plurality of pockets, wherein the recesses do not extend down as far as a bottom surface of the plurality of pockets.

10. The combination of claim 7 wherein the stacking feet on one of the pair of opposed side walls of the first bakery tray are closer to one another than the stacking feet on the other of the pair of opposed side walls of the first bakery tray.

11. The combination of claim 7 wherein on one of the side walls of the first bakery tray, the upper support surface outward of the stacking feet pockets is the same height as the upper support surface between the stacking feet.

12. The combination of claim 11 wherein on each side wall of the first bakery tray a channel is defined between the inner rail and the outer wall, the channel defined at longitudinal ends by stops aligned with the front and rear walls of the first bakery tray.

13. The combination of claim 12 wherein the rear wall of the first bakery tray is shorter than the side walls of the first bakery tray.

14. The combination of claim 13 wherein the side walls of the first bakery tray each include a planar interior wall portion having a plurality of ribs projecting outwardly of the first bakery tray therefrom.

15. The combination of claim 14 wherein the stacking feet and the center projection of the first bakery tray are below the plurality of ribs projecting from the side walls of the first bakery tray.

16. A bakery tray comprising:

a base;

a front wall extending upward from a front edge of the base;

a rear wall extending upward from a rear edge of the base; and a pair of opposed side walls extending upward from side edges of the base, wherein the front wall is shorter than the side walls, each side wall including a pair of stacking feet and a center projection, each side wall including an upper support surface between an inner rail and an outer wall, the inner rail interrupted by a plurality of stacking feet pockets arranged to receive the stacking feet of an identical bakery tray stacked thereon in a high stack position and in a low stack position, the inner rail interrupted by a center pocket arranged to receive the center projection of the identical bakery tray stacked thereon in the high stack position and in the low stack position, wherein for each side wall the upper support surface between one of the stacking feet pockets and the center pocket is the same height as the upper support surface between the other of the stacking feet pockets and the center pocket, wherein the stacking feet on one of the pair of opposed side walls are closer to one another than the stacking feet on the other of the pair of opposed side walls.

17. The bakery tray of claim 16 wherein on one of the side walls, the upper support surface outward of the stacking feet pockets is the same height as the upper support surface between the stacking feet.

18. The bakery tray of claim 17 wherein on each side wall a channel is defined between the inner rail and the outer wall, the channel defined at longitudinal ends by stops aligned with the front and rear walls of the bakery tray.

19. The bakery tray of claim 18 wherein the rear wall is shorter than the side walls.

20. The bakery tray of claim 19 wherein the side walls each include a planar interior wall portion having a plurality of ribs projecting outwardly of the bakery tray therefrom.

21. The bakery tray of claim 20 wherein the stacking feet and the center projection are below the plurality of ribs projecting from the side walls.

22. The bakery tray of claim 21 further including a single stacking height tray stacked thereon, the single stacking height tray including a base, side walls, front and rear walls, the single stacking height tray further including an outer rib and an inner rib projecting downward from an outer edge of the single stacking height tray, the inner rail of the bakery tray received between the outer rib and the inner rib of the single stacking height tray.

23. The bakery tray and the single stacking height tray of claim 22, wherein the single stacking height tray does not include stacking feet or pockets for receiving stacking feet.

* * * * *